US008341998B2

(12) United States Patent
Saito et al.

(10) Patent No.: US 8,341,998 B2
(45) Date of Patent: Jan. 1, 2013

(54) FORMING APPARATUS AND FORMING METHOD

(75) Inventors: Taku Saito, Hachioji (JP); Naoki Watanabe, Ebina (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 297 days.

(21) Appl. No.: 12/765,151

(22) Filed: Apr. 22, 2010

(65) Prior Publication Data

US 2010/0275671 A1 Nov. 4, 2010

(30) Foreign Application Priority Data

Apr. 30, 2009 (JP) ..... 2009-110697

(51) Int. Cl.
*B21D 53/04* (2006.01)

(52) U.S. Cl. ..... 72/379.6

(58) Field of Classification Search ..... 72/379.6, 72/385, 399, 403
See application file for complete search history.

(56) References Cited

U.S. PATENT DOCUMENTS

| | | | | |
|---|---|---|---|---|
| 4,052,948 | A * | 10/1977 | Straza et al. | 72/305 |
| 8,082,770 | B2 * | 12/2011 | Bowman et al. | 72/385 |
| 8,151,617 | B2 * | 4/2012 | Feng et al. | 72/379.6 |
| 2004/0093927 | A1 * | 5/2004 | Leon et al. | 72/385 |
| 2007/0098835 | A1 * | 5/2007 | Akishev et al. | 425/396 |

FOREIGN PATENT DOCUMENTS

JP 4-33723 A 2/1992

* cited by examiner

*Primary Examiner* — Faye Francis
(74) *Attorney, Agent, or Firm* — Holtz, Holtz, Goodman & Chick, PC

(57) ABSTRACT

A forming apparatus to bend a plate-shaped material, including: a first forming device to bend one surface of the plate-shaped material not more than 180 degrees by pressing the plate-shaped material; a second forming device to bend another surface of the plate-shaped material not more than 180 degrees by pressing the plate-shaped material; wherein the first and the second forming device perform bending while changing a relative position by interlocking with each other.

12 Claims, 21 Drawing Sheets

FORMING APPARATUS AND FORMING METHOD

This application is based on Japanese Patent Application No. 2009-110697 filed on Apr. 30, 2009, in Japanese Patent Office, the entire content of which is hereby incorporated by reference.

BACKGROUND OF THE INVENTION

The present invention relates to a forming apparatus to form a part in a shape of a plate such as a metal and a forming method the same.

TECHNICAL FIELD

As a parts which is formed by bending a plate-like part at a plurality of positions, for examples, there are parts in a shape of W character which is formed by bending a metal plate in a W character shape shown in FIG. 23, and a part provided with a projection section at a portion of a metal plate which bended in a L character shape shown in FIG. 23(*b*). The above parts are used for various structures, since bending strength against an external force can be increased compared to a piece of simple plate material.

Conventionally, as a method to form a W-shape parts form a plate-shaped material, there has been a method to form the W-shape part from the plate-shaped part via a plurality of processes. Also, there has been a forming method to form the part with the projection section by drawing.

As the method to form the W-shape part via a plurality of the processes, for example, there have been known a method that the plate-shaped material is formed in a shape of a V character with a pair of a punch and a die in the V-shape, then the plate-shaped material is displaced so as to form another V-shape next to the V-shape to obtain the W-shape part and a method that a pair of a punch and a die in W-shape performs drawing work with respect to the plate-shaped material to obtain the W-shape part.

Also, as a method to form the aforesaid part having the projection section, there has been known a method that a plate-shaped material, on which slits are punched intermittently at a position supposed to be a ridge line of the projection section, is bent at the ridge line by pushing the part to be a projection section so as to protrude the position to be a projection section (for example, Patent Document 1: Unexamined Japanese Patent Application Publication No. H4-33723)

Patent Document 1: Unexamined Japanese Patent Application Publication No. H4-33723

SUMMARY

However, there have been problems that the aforesaid methods via the plurality of the processes require a long working time and productivity is deteriorated, also safeness of the work is deteriorated by injuries when the material is moved manually.

Also, in the drawing work, there have been problems that since the material is extended, a thin section is created and the strength is deteriorated, in addition ensuring of accuracy is difficult.

Also, in the forming method described in the Patent Document 1, the projection section can be formed unfailingly in one process, however there is problem that since the portion where the slits are punched intermittently on the ridge line of the projection portion is weak in the bending resistance, there is a possibility that the mechanical strength against the external force is deteriorated.

An aspect of the present invention is to provide a forming apparatus and a forming method which enable manufacturing a large amount of the steel plate part formed by bending the plate-shaped material having a high mechanical strength, and ensuring required accuracy, with less occurrence of scratches while working, in a unit time.

The above object is achieved by the following.

1. A forming apparatus to bend a plate-shaped material, including: a first forming device to bend one surface of the plate-shaped material not more than 180 degrees by pressing the plate-shaped material; a second forming device to bend another surface of the plate-shaped material not more than 180 degrees by pressing the plate-shaped material; wherein the first and the second forming devices perform bending while changing a relative position by interlocking with each other.

2. A forming method of a plate-shaped part using a forming apparatus, to bend a plate-shaped material, includes: bending one surface of the plate-shaped material not more that 180 degrees by pressing the plate-shaped material by a first forming device; and bending an other surface of the plate-shaped material not more than 180 degrees by pressing the plate-shaped material by a second forming device while changing relative position with respect to the first forming device in accordance with progress of forming so as to coordinate with the first forming device.

DETAILED DESCRIPTION OF PREFERRED EMBODIMENTS

A forming apparatus and a forming method to process a plate-shaped material such as metal will be described with reference to the drawings. Since the present invention focuses on bending the plate-shaped material, bending of plate-shaped material such as metal will be described.

Incidentally, a direction to push the plate-shaped material is called a first direction and a ridge line created on the plate-shaped material as a result of bending work by pushing is called a third direction and a direction perpendicular to the aforesaid two directions is called a second direction.

Meanwhile, in the following figures, the first direction is a thickness direction (t direction in figure), the second direction is a longitudinal direction perpendicular to the thickness direction of the plate-shaped material, for example, a height direction of the bending apparatus (y direction in the figure) and the third direction is a lateral direction perpendicular to both the thickness direction and the longitudinal direction of the plate-shaped material, for example a depth direction (x direction in the figure) of the bending apparatus.

The descriptions of "perpendicular" and "parallel" are ideally perpendicular and parallel, however, practically, they are substantially perpendicular and parallel, which allow tolerances of for example, ±1 degree.

The plate-shaped material such as metal is simply called as the plate-shaped material, the apparatus performs bending work with respect to the plate-shaped material is called bending apparatus.

Figure 1:
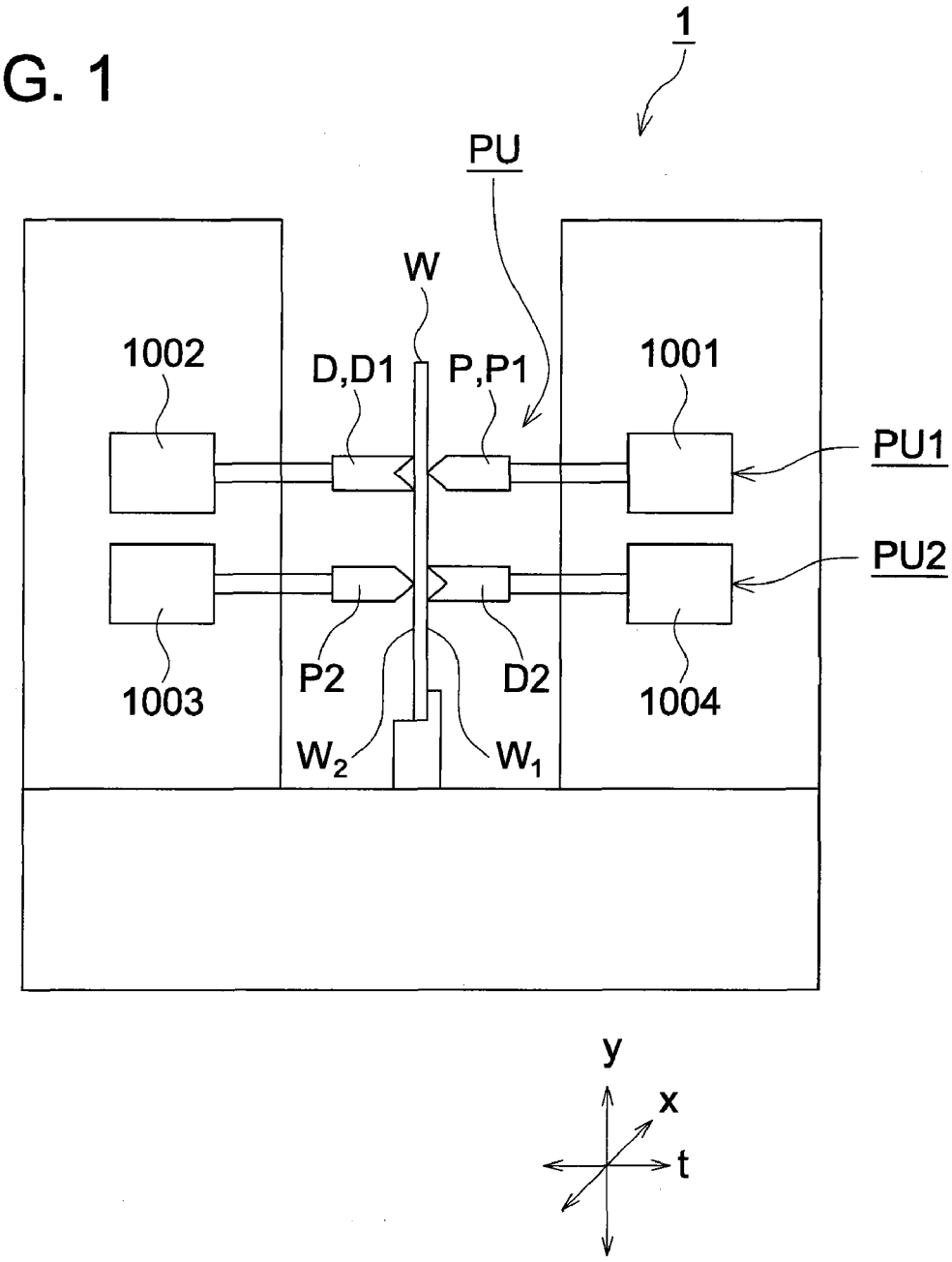
FIG. 1 is an explanatory diagram of a first example of a bending apparatus which bends a plate-shaped material W by biasing a punch P and a die D by a motor.
Figure 2:
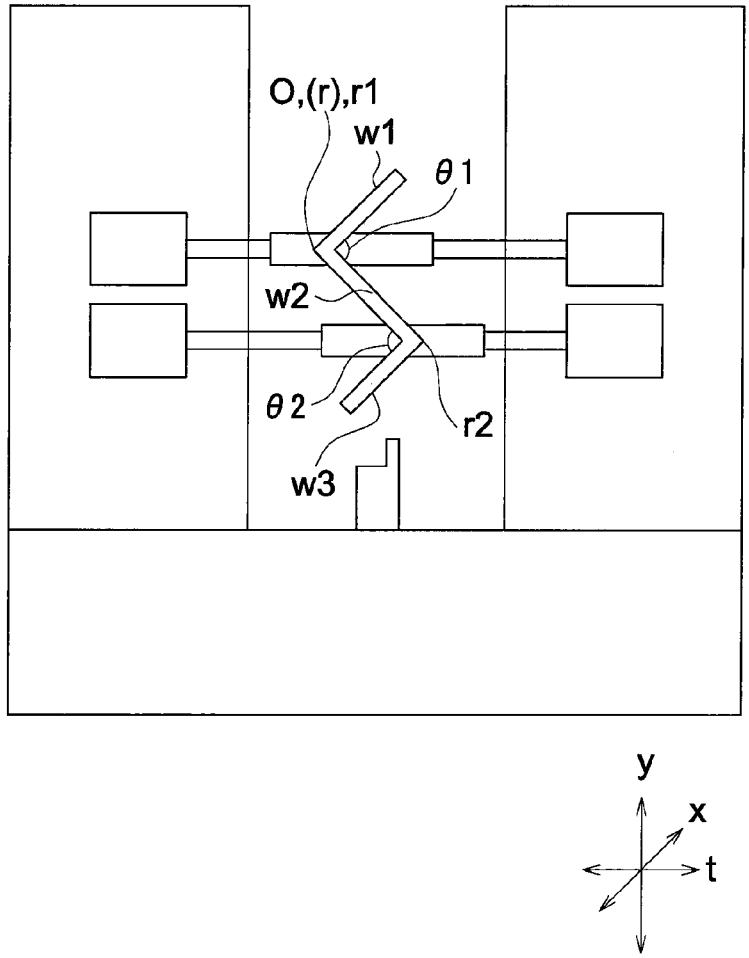
FIG. 2 is an explanatory diagram of a first example of a bending apparatus which bends a plate-shaped material W by biasing a punch P and a die D by a motor.
Figure 3:
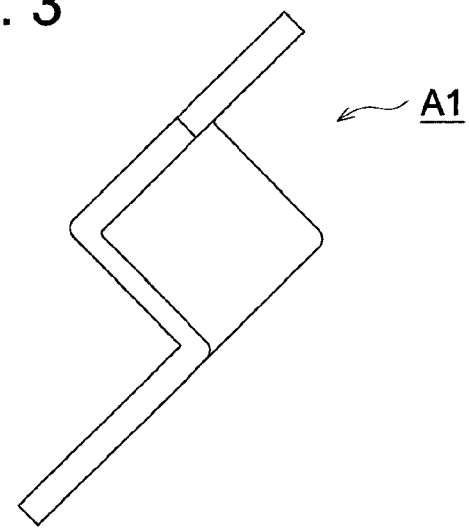
FIG. 3 is a perspective view of a part which is formed by bending a plate-shaped material such as steel in a Z-shape by the bending apparatus 1.

FIG. 1 and FIG. 2 are explanatory diagrams of a first example of the bending apparatus which bends the plate-shaped material W by biasing the punch P and the Die D via a motor, and FIG. 3 is a perspective view of a part formed in a Z-shape by bending the plate-shaped material W such as metal with the bending apparatus 1.

Specifically, FIG. 1 shows a time point where the plate-shaped material W such as metal is set in the bending apparatus 1, and FIG. 2 shows a time point when bending work of the plate-shaped material such as metal is completed.

In FIG. 1 and FIG. 2, the bending apparatus 1 is provided with a plurality of punch units PU which bend the plate-shaped material by the punch P and the die D by pressing (for example, a punch unit PU1 representing a first forming device and a punch unit PU2 representing a second forming device). A single punch unit PU1 and a single punch unit PU2 are disposed in a y direction alongside.

Here, a plurality of the punch units PU (for example, the punch unit PU1 and the punch unit PU2) disposed in a different position with respect to the y direction are disposed so that the bending directions are opposed in a positional relation of the punch P and die D with respect to a surface of the plate-shaped material W. For example, the punch unit PU1 has a punch P1 at a side $W_1$ and the die D1 at a side $W_2$ and contrarily the punch unit PU2 has the die D2 at the side $W_1$ and a punch P2 at the side $W_2$ so that bending directions by the adjacent punch units with respect to the plate-shaped material are opposite.

Namely, the punch unit PU1 representing a first forming device bends a surface of the plate-shaped material W not more than 180 degree by pressing the plate-shaped material W, and the punch unit PU2 representing the second forming device bends the other surface of the plate-shaped not more than 180° by pressing the plate-shaped material W.

A moving device 1001 to enable moving of the punch P1 in the y direction and the t direction simultaneously is connected with the punch P1 of the punch unit PU1 and a moving device 1002 to enable moving of the die D1 in the y direction and the t direction simultaneously is connected with the die D1. Further a moving device 1003 to enable moving of the die punch P2 in the y direction and the t direction simultaneously is connected with the punch P2 of the punch unit PU2 and a moving device 1004 to enable moving of the die D2 in the y direction and the t direction simultaneously is connected with the die D2.

Incidentally lengths of the punches P1 and P2, dies D1 and D2 in the x direction is at least the same as the width of the plate-shaped material W or is not less that the width of the plate-shaped material.

Forming work will be described. An unillustrated control device controls a plurality of moving device so that, for example, moving devices 1001 and 1002, and 1003 and 1004 coordinate with each other.

Here, coordinate means that bending angles θ (for example θ1 and θ2) created by two planes (for example, plane w1 and w2 and w2 and w3) which sandwiches a ridge r (for example, ridge r1 and r2) of each bending section O of plate-shaped material W bent by a plurality of pair of punches P and dies D (for example, punch P1 and die D1, and punch P2 and die D2)

coincide during bending, and the plate-shaped material W (for example, surface w2) located between the punch unit PU1 and the adjacent punch unit PU2 disposed in the y direction always maintains a flat surface (a straight line in the figure) during bending, further the punch P1, the die D1, the punch P2 and the die D2 are coordinated and moved in the t and y directions so that the surfaces (for example surface w1 and w3) of plate-shaped material W become parallel each other when bending is completed, or extended surfaces of the aforesaid surfaces are always parallel during bending.

As described above, bending is carried out by moving and coordinating the punch P1, the die D1, the punch P2 and the die D2 relatively in the t and y directions to bend a plurality of positions, namely bending of the plurality of positions is carried out in one process, thus the productivity is enhanced without the material being extended such as in drawing work, and deterioration of strength of the completed part is avoided.

Here, during bending means starting of deformation by pushing the plate-shaped material W to completion of bending where the punch and the die substantially contact via the plate-shaped material W.

By forming tip sections of the punches P1 and P2 into projection sections in triangle shapes having angles less than 180° and forming the tip sections of the dies D1 and D2 into recessed sections in triangle shapes having an angle less than 180°, a bending press part having a discretionary bending angle θ can be formed.

Also, by forming the tip sections of the punches P1 and P2 into projection sections in triangle shapes having angles less than 90° and forming the tip section of the dies D1 and D2 into the recessed sections in triangle shapes having an angle less than 90°, a bending press part A1 having bending angle θ of 90° shown in FIG. 3 can be formed.

Also, it is preferable that all the tip sections of the punches P (projection section in the triangle shape) have the same shape and all the tip sections of the dies D (recessed section in triangle shape) have the same shape. In this ease, control can be simplified, by starting of movement the punches P and dies D at the same time with the same moving speed.

By utilizing the configuration described above, the bending angles θ of two bending positions can coincide during all bending work by the two pair of the punching units, and the plate-shaped material located between the two pair of punch units can always maintain the plane surface (the straight line in the figure) during bending work. Thus, bending work for two positions can be carried out in one process and production volume in a unit time can be increased, also the bending press parts can be safely produced since the plate-shaped material does not have to be replaced. Further, the plate-shaped material can be formed without slippage between the punch and the die. Whereby, there can be provided a bending apparatus for the plate-shaped material which enables production of a bending press part having a high mechanical strength, while maintaining a required accuracy with less occurrence of flaws during press work.

Figure 4:
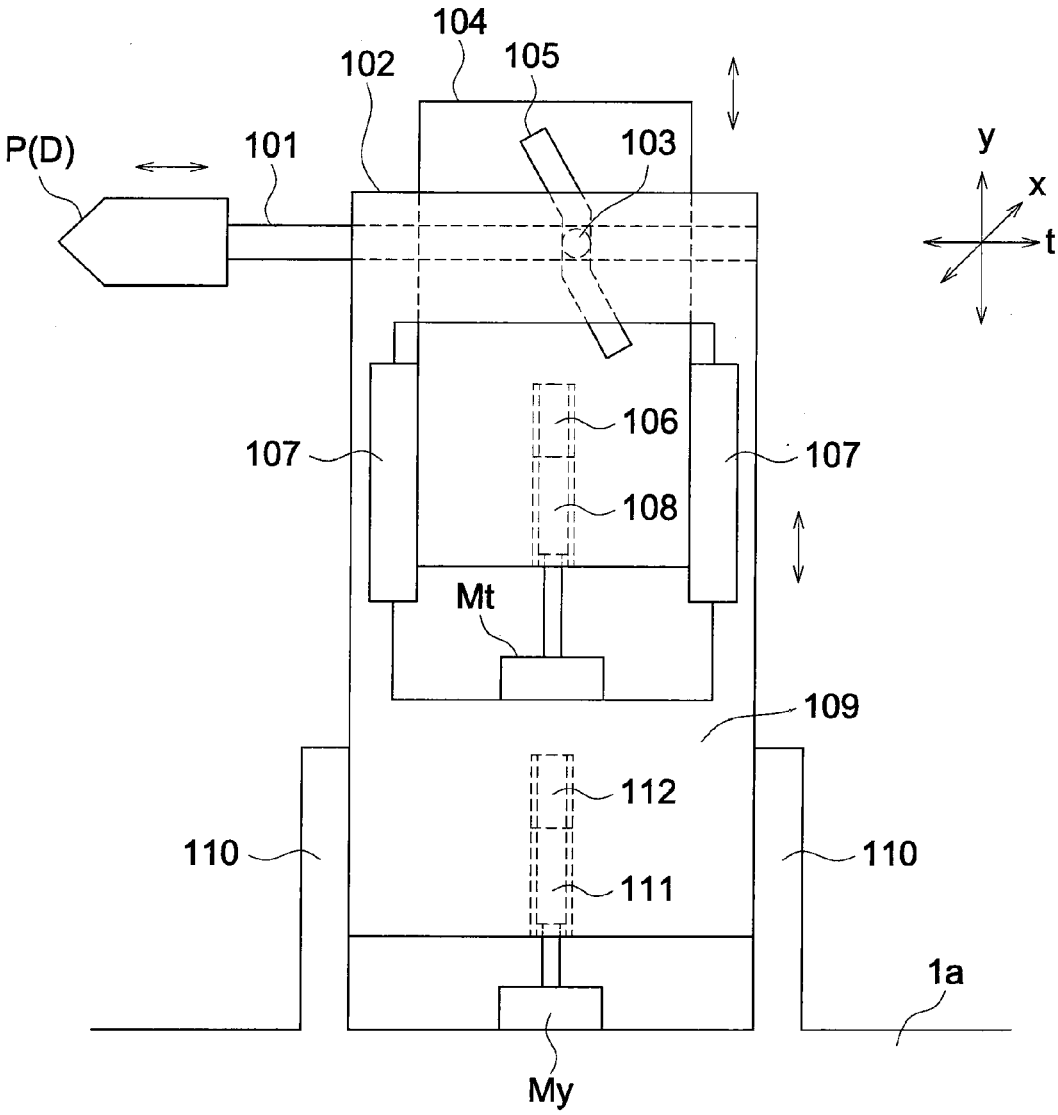
FIG. 4 is an explanatory diagram of an example of moving device 10.

FIG. 4 is a detailed explanatory diagram of an example of a moving device 10.

All the punches and dies of bending apparatus to bend plate-shaped material W by biasing the punch P and die D via a motor are connected to the following moving device. All the punches and dies are configured to be movable simultaneously in the t and y directions through the moving device. An example of the moving device will be described with punch P as an example. Incidentally, the moving device is not limited to the following configuration and any configurations enabling the punch P and die D to move in the t and y directions are possible.

First, moving of punch P (die D) in the t direction will be described.

The punch P is fixed on the punch support shaft 101 to support the punch. The punch supporting shaft 101 is supported by a guide member 102 in a sliding manner in the t direction. The punch support shaft 101 has a cam follower 103 and the can follower 103 is fitted with a cam groove 105 formed on a cam plate 104 which moves the punch P in the t direction.

As the figure shows, the cam plate 104 provided with the cam groove 105 inclining in the t direction and a female screw 106, is movable in the y direction while being guided by the guide plate 107. The female screw 106 is engaged with a male screw 108 disposed at a motor output shaft of the motor Mt to move the punch P in the t direction.

The male screw 108 rotates by rotation of the motor Mt and the cam plate 104 moves in the y direction via the female screw 106. By the above movement, the punch support shaft 101, namely the punch P moves in the t direction via the cam follower 103 and the cam groove 105.

Incidentally, the guide member 102 is fixed integrally with a block 109 which moves the guide member 102 in the y direction and the guide plate 107, and the motor Mt which move the punch P in the t direction are fixed on the block 109. With the above configuration, by rotation of the motor Mt, the punch P can be moved in the t direction via cam plate 104, the cam follower 103 and the punch support shaft 101.

Next, moving of punch P in they direction will be described.

A block 109 is supported by a guide member 110 fixed on a base 1*a* in a sliding manner in the y direction. The block 109, having a female screw 112 engaging with a male screw 111 disposed on a motor output shaft of a motor My which moves the block 109 in the y direction, can be moved in the y direction being guided by the guide member 110. Then the male screw 111 rotates by rotation of the motor My fixed on the base 1*a* and the block 109 moves in the y direction via the female screw 112, and the punch P moves in the y direction via the guide member 101 by the above movement.

Here, the motor Mt represents a drive source to move the punch in a first direction (t direction) and represents a drive source to move the die in a first direction (t direction). The motor My represents a drive source to move the punch in a second direction (y direction) and represents a drive source to move the die in the second direction (y direction).

Also, the above guide member 102 to the male screw 111 to move the punch P integrally represents a punch moving section, and the above guide member 102 to the male screw 111 to move the die D integrally represents a die moving section.

Incidentally, the motor Mt and motor My are connected with a control device (unillustrated), and movement of the punch and die in the t and y directions are controlled by the control device. For example, if the motor Mt and motor My are driven to rotate at the same time by the control device, the punch or die can be moved in both the t and y directions at the same time.

A pulse motor or a servo motor can be used for the motor Mt and the motor My to precisely position the punch and the die. In order to obtain large biasing force and highly precise amount of rotations, a hydraulic pulse motor may be used.

In case the pulse motor is used for the motor Mt and the motor My, a measurement of displacement amount of the punch and the die in y-direction and t-direction can be realized by calculating the drive pulse of the motor Mt and the motor My and converting the number of pulses into the displacement amount. In case the servo motor is used for the motor Mt and the motor My, the measurement of displacement amount of the punch and the die in y-direction and t-direction can be realized by calculating the pulse of a pulse encoder provided at an output shaft of the motor Mt and motor My and converting the number of pulses into the displacement amount An actual position of the punch and the die in the t-direction can be detected by calculating each pulse after a starting point sensor (not illustrated), which outputs a starting point signal at the time when the leading edges of the punch and the die that have been separated from a plate-shaped material W come into contact with the plate-shaped material W, sends out an output. An actual position of the punch and the die in the y-direction can be detected by calculating each pulse after a lower limit sensor (not illustrated), which detects the lower limit position in the y-direction, detects the lower limit.

The value of the bending angle, which is formed by two surfaces that sandwich a ridge of each bending section of the plate-shaped material bent by a plurality of pairs the punch P and the die D, is maintained the same during the bending process. Also the surfaces of the plate-shaped material or the extended surface of those surfaces that become parallel to each other at the time of completion of the bending process are maintained to be parallel to each other at all times during the bending process. Required moving amount information of the punch and the die in the t-direction and the y-direction for prescribed period of time that is needed for the plate-shaped material disposed between the adjacent punch units to maintain a fair surface during the bending process is memorized in a memory device (not illustrated) in advance.

With respect to a processing method, a control device compares the calculated number of pulses of the motor Mt and the motor My during the bending processing with the memorized required moving amount information of the punch and the die in the t-direction and the y-direction for a prescribed period of time during the bending processing. Then the control device controls the motor Mt and the motor My so that the calculated number of pulses and the memorized required moving amount information coincide.

By configuring a bending apparatus with the above described configuration, the value of the bending angle, which is formed by two surfaces that sandwich a ridge of each bending section of the plate-shaped material bent by a plurality of pairs of the punch P and the die D, is maintained the same during the bending process. Also the surfaces of the plate-shaped material or the extended surface of those surfaces that become parallel to each other at the time of completion of the bending process are maintained to be parallel to each other at all times during the bending process. As a result, the plate-shaped material disposed between the adjacent punch units always maintains a fair surface during the bending process.

Figure 5:
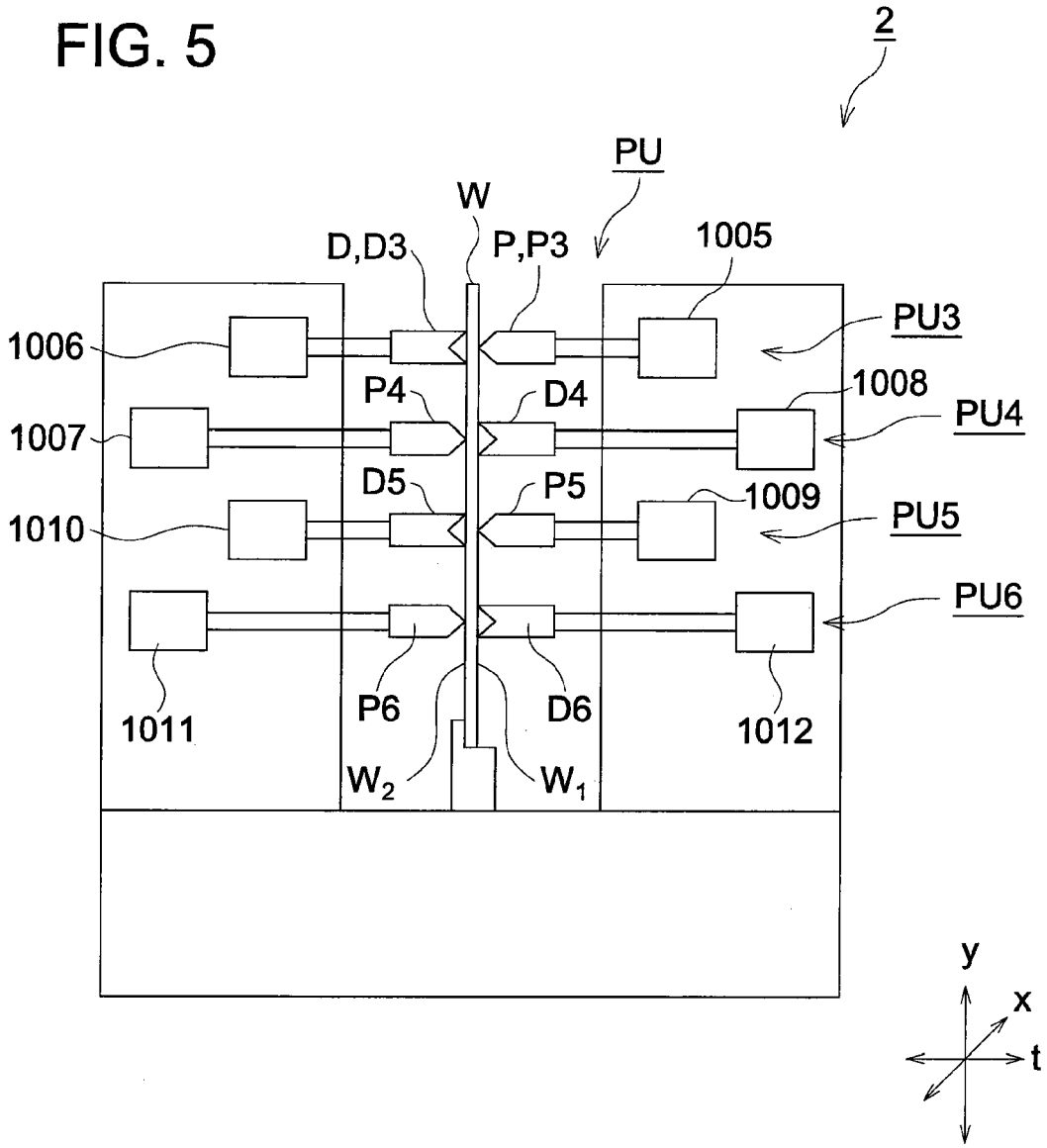
FIG. 5 is an explanatory diagram of a second example of a bending apparatus which bends a plate-shaped material W by biasing a punch P and a die D by a motor.
Figure 6:
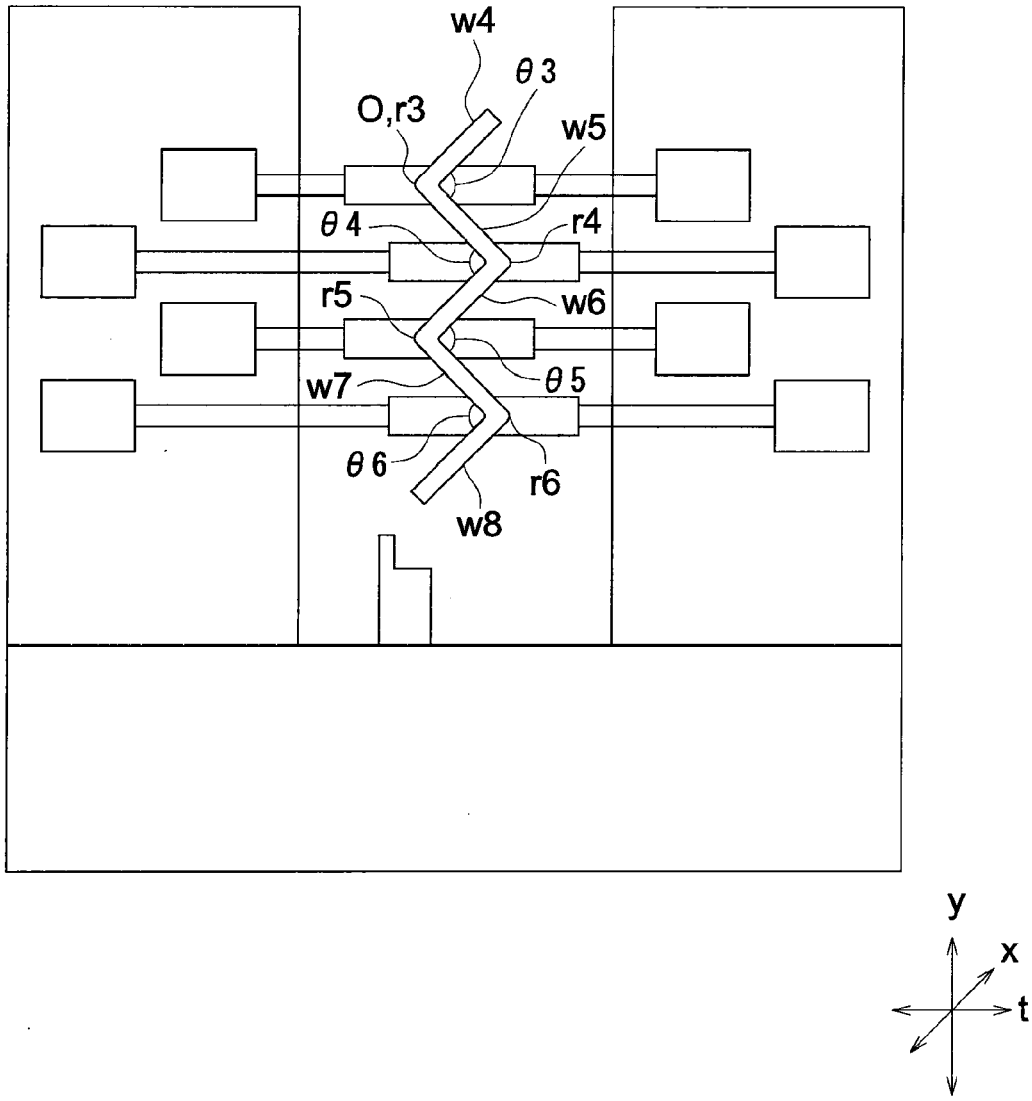
FIG. 6 is an explanatory diagram of a second example of a bending apparatus which bends a plate-shaped material W by biasing a punch P and a die D by a motor.
Figure 7:
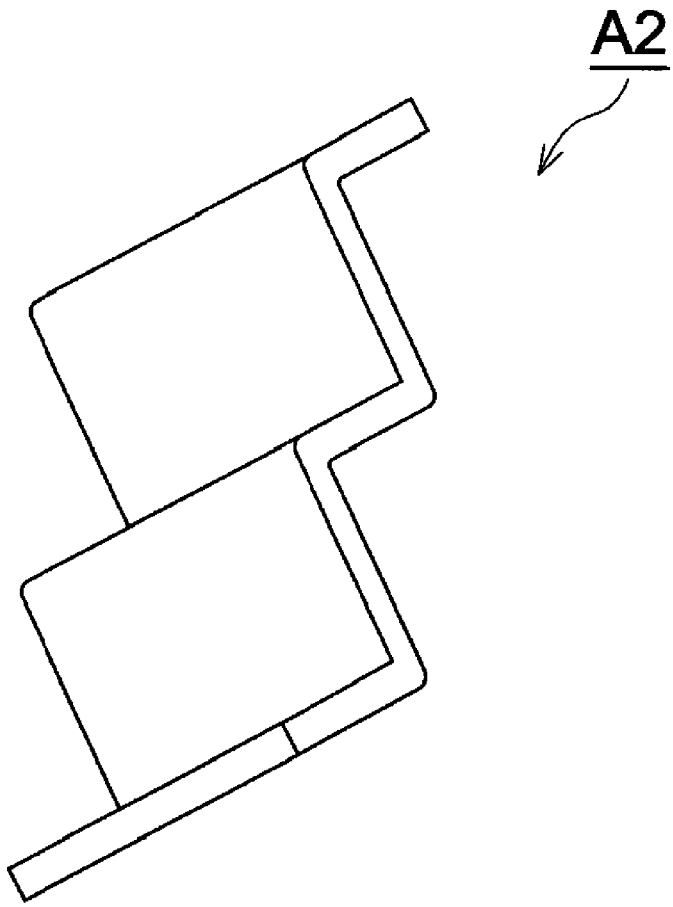
FIG. 7 is a perspective view of a part which is formed by bending the plate-shaped material at more than two positions through the bending apparatus 2.

FIGS. 5 and 6 illustrate explanatory diagrams of a second example of a bending apparatus for bending the plate-shaped material W by energizing a punch P and a die D with a motor. FIG. 7 illustrates a perspective view of a part onto which a bending process has been performed on not less than two sections of the plate-shaped material W by a bending apparatus 2.

In detail, FIG. 5 illustrates a time when the plate-shaped material W has been set in the bending apparatus 2, and FIG. 6 illustrates a time when the bending process to the plate-shaped material W has completed.

The bending apparatus 2 includes a plurality of punch units PU (for example, punch unit PU3-punch unit PU6), which bends the plate-shaped material W by pressing the plate-shaped material W with a punch P and a die D. The punch unit PU3-punch unit PU6 are disposed collaterally along the y-direction.

Here, the plurality of punch units (for example, punch unit PU3-punch unit PU6) is disposed at different positions with respect to y-direction. With respect to the spatial relationship of the punch P and the die D against the surface of the plate-shaped material W, the plurality of punch units is arranged so that the bending direction to the plate-shaped material W is opposite of that of an adjacent punch unit.

For example, with respect to the punch unit PU3 in which punch P3 is disposed on a surface $W_1$ side and die D3 is disposed on a surface W2 side, the punch unit PU4 is arranged so that die D4 is disposed on the surface $W_1$ side and punch P4 is disposed on the surface $W_2$ side. Also, with respect to the punch unit PU4 in which the die D4 is disposed on the surface $W_1$ side and the punch P4 is disposed on the surface $W_2$ side, the punch unit PU5 is arranged so that punch P5 is disposed on the surface $W_1$ side and die D5 is disposed on the surface $W_2$ side. Also, with respect to the punch unit PU5 in which the punch P5 is disposed on the surface $W_1$ side and the die D5 is disposed on the surface $W_2$ side, the punch unit PU6 is arranged so that die D6 is disposed on the surface $W_1$ side and the punch PG is disposed on the surface $W_2$ side. The plurality of punch units is arranged in this manner so that the bending direction to the plate-shaped material is the opposite of the adjacent punch unit.

That is, the punch units PU3 and PU5 bend one surface of the plate-shaped material W to not more than 180 degrees by pressing the plate-shaped material W. Then the punch units PU4 and PU6 bend the other surface of the plate-shaped material W to not more than 180 degrees by pressing the plate-shaped material W.

A moving device 1005, which enables the punch P3 to move in y-direction and t-direction simultaneously, is connected to the punch P3 of the punch unit PU3. A moving device 1006, which enables the die D3 to move in y-direction and t-direction simultaneously, is connected to the die D3 of the punch unit PU3. A moving device 1007, which enables the punch P4 to move in y-direction and t-direction simultaneously, is connected to the punch P4 of the punch unit PU4. A moving device 1008, which enables the die D4 to move in y-direction and t-direction simultaneously, is connected to the die D4 of the punch unit PU4.

In the similar manner, moving devices 1009 and 1010, which enable the punch P5 and the die D5 to move in y-direction and t-direction simultaneously, are connected to punch P5 and the die D5 of the punch unit PU5, respectively. Moving devices 1011 and 1012, which enable the punch P6 and the die D6 to move in y-direction and t-direction simultaneously, are connected to punch P6 and the die D6 of the punch unit PU6.

Punches P3-P6 and dies D3-6 have the length that is the same as or more than the width of the plate-shaped material W in the x-direction.

With regards to the description of a processing method, a non-illustrated control device controls a plurality of moving devices, for example, the moving devices 1005-1012, so that the plurality of moving devices moves in response to each other.

The value of the bending angle θ (for example, θ3-θ6), which is formed by two surfaces (for example, surfaces w4 and w5, surfaces w5 and w6, surfaces w6 and w7 and surfaces w7 and w8), that sandwich a ridge (for example, ridges r3-r6) being a bent section O bent by the punch P and the die D (for example, the punch P3 and the die D3, the punch P4 and the die D4, the punch P5 and the die D5 and the punch P6 and the die D6), is maintained the same during the bending process. Also the surfaces (for example, surfaces w4, w6 and w8 and surfaces w5 and w7) of the plate-shaped material or the extended surface of those surfaces that become parallel to each other at the time of completion of the bending process are maintained to be parallel to each other at all times during the bending process. Moving in response to each other refers to controlling and moving the punch P3, the die D3, the punch P4, the die D4, the punch P5, the die D5, the punch P6 and the die D6 in response to each other so that the plate-shaped material W (for example, surfaces w5-w7), which is arranged between the punch unit PU3 and the punch unit PU4, the punch unit PU4 and the punch unit PU5 and the punch unit PU5 and the punch unit PU6 disposed adjacent to each other in the y-direction, maintains a fair surface (straight line in the figure) during the bending process.

As described above, a bending process is performed to a plurality of places on the plate-shaped material by moving the punch P3 and die D3-the punch P6 and die D6 in response to each other and relatively moving the punch P3 and die D3-the punch P6 and die D6 to the t-direction and y-direction, respectively. That is, a bending process to a plurality of places can be performed in one process. Therefore, productivity can be improved, and reduction of strength of the completed parts can be prevented without stretching the material just as in a drawing process.

A bent sheet metal part having an arbitrary bending angle θ can be processed by arranging a leading edge section of the punch P3-punch P6 with a triangle-shaped convex section having less than 180 degree angle on a leading edge section and by arranging a leading edge section of the die D3-die D6 with a triangle-shaped concave section having less than 180 degree angle on the trough just as in the punch P3-punch P6.

A bent sheet metal A2 having 90 degrees of a bending angle θ as illustrated in FIG. 7 can be processed by arranging a leading edge section of the punch P3-punch P6 with a triangle-shaped convex section having 90 degree angle on a leading edge section and by arranging the leading edges of the die D3-die D6 with a triangle-shaped concave section having 90 degree angle on the trough just as in the punch P3-punch P6.

It is desirable that the shape of the leading edge section (triangle-shaped convex section) of all the punches P is the same, and the shape of the leading edge section (triangle-shaped concave section) of all the die D is the same. In this case, starting time of the movement of all the punches P and dies D is set to the same time, and speed of the movement of all the punches P and dies D can be set to the same speed. Thus, the control can be simplified.

A case in which the bending process was performed to four places of the plate-shaped material W has been described above. However, it is needless to mention that the bending process can be performed to arbitrary numbers of places on the plate-shaped material by disposing a number of punch units PU in the y-direction. Also it is needless to mention that the interval of each punch unit in the y-direction may be the same or may differ.

By configuring the bending apparatus 2 with the configuration described above, the bending angle θ of the four bending sections is maintained to an equal value at all times during the bending process by each of the moving devices of four pairs of the punch unit. Also, surfaces or extended surfaces of the plate-shaped material W, which become mutually parallel at the time of completion of the bending process, are held parallel at all times during the bending process. Hence, the plate-shaped material placed between the four pairs of punch unit can maintain a fair surface (straight line in the illustration) at all times during the bending process.

Thereby, the bending of four places can be performed in one process. Thus, there is no need to replace the plate-shaped material. The bent sheet metal part can be safely produced while increasing the amount of production per unit of time.

Also the plate-shaped material is processed without sliding between the punch and the die. Therefore, a plate-shaped material bending apparatus with high mechanical intensity that can produce a high quality bent sheet metal without scratches.

A bending apparatus that is capable of bending the near side and far side in x-direction of the plate-shaped material W differently will be described hereafter.

Figure 8:
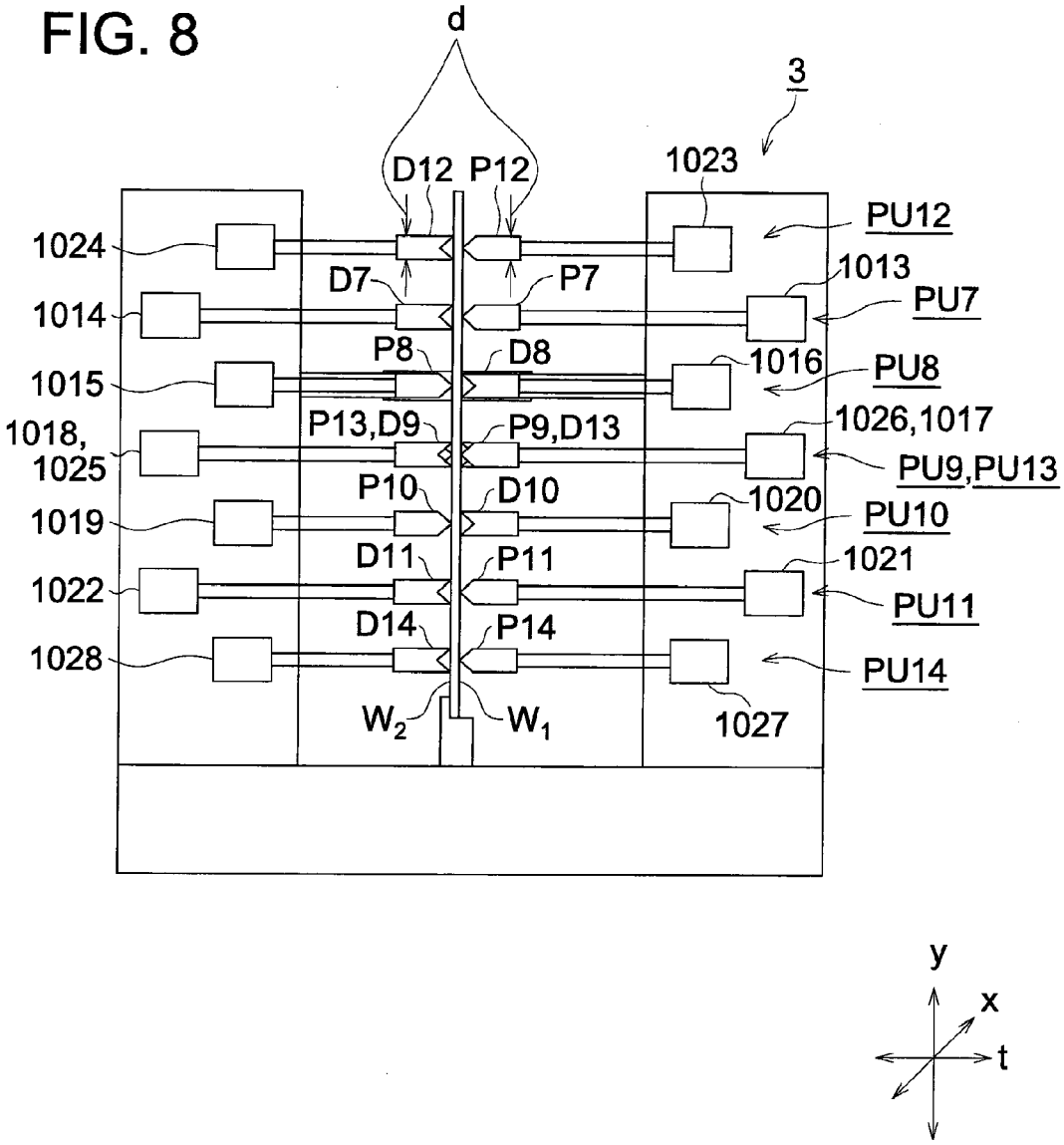
FIG. 8 is an explanatory diagram of a third example of a bending apparatus to carry out different bending works in a back side and a front side in a x direction of the plate-shaped material W by biasing a punch P and a died through a motor.
Figure 9:
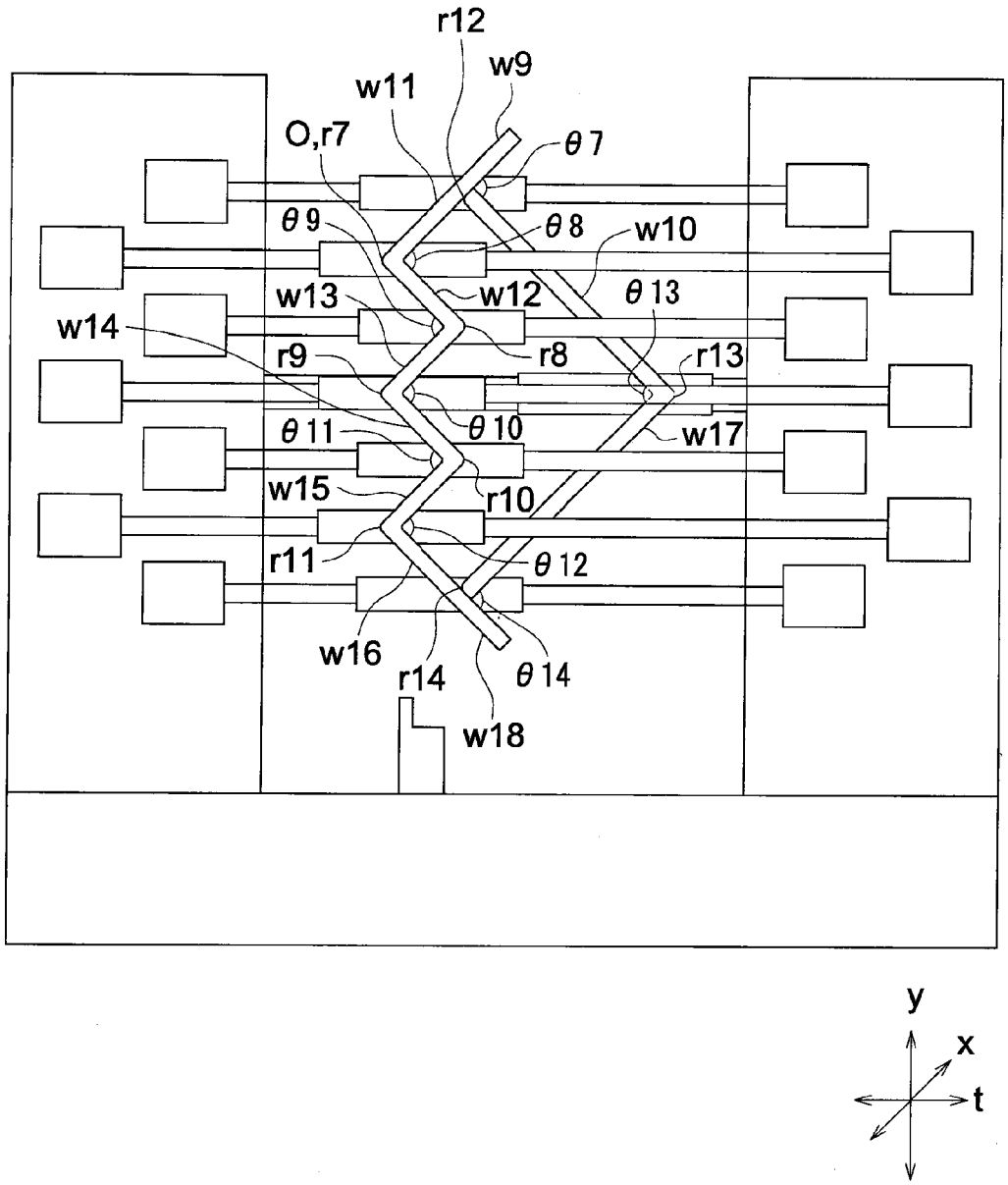
FIG. 9 is an explanatory diagram of a third example of a bending apparatus to carry out different bending works in a back side and a front side in a x direction of the plate-shaped material W by biasing a punch P and a died through a motor.
Figure 10:
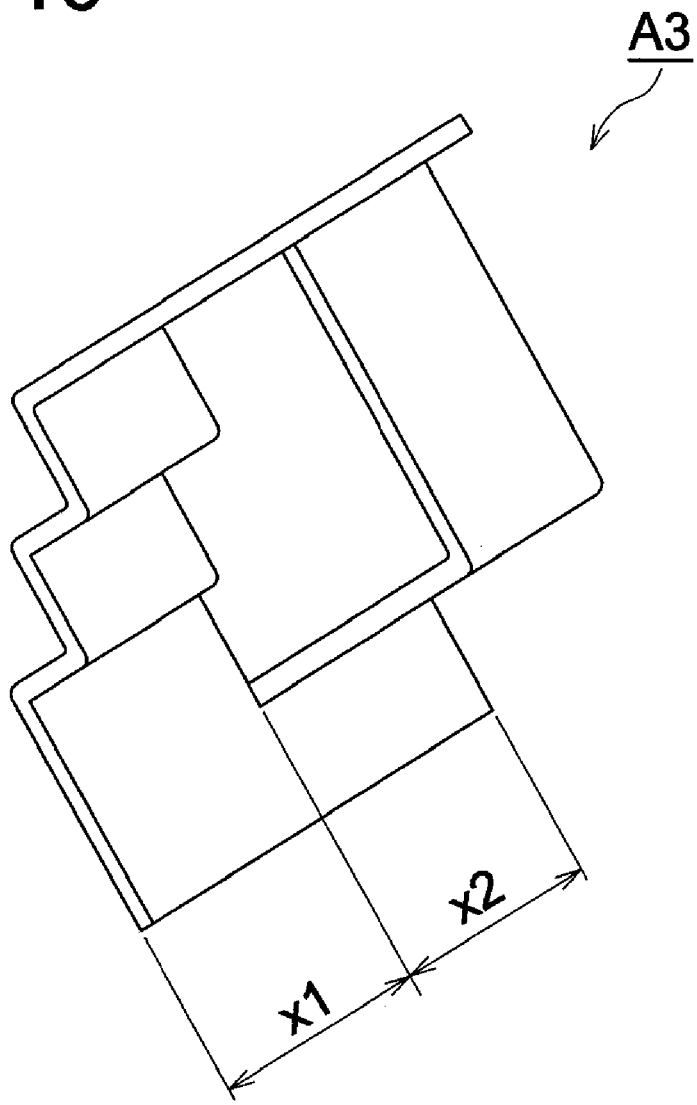
FIG. 10 is a perspective view of a part having been subject to different bending works in a back side and a front side with respect to a X direction representing a third direction which is perpendicular to both a first direction (t direction) and a second direction (y direction) which is perpendicular to the t direction.

FIGS. 8 and 9 illustrate explanatory diagrams of a third example of a bending apparatus for performing bending processing to the near side and the far side in x-direction of the plate-shaped material W differently by energizing the punch P and the die D with the motor. FIG. 10 illustrates a perspective view of a part onto which a different bending process has been performed to the near side and the far side in x-direction of the plate-shaped material being a third direction which is perpendicular to a first-direction (t-direction) and a second direction (y-direction), which is perpendicular to the t-direction.

In detail, FIG. 8 illustrates a time when the plate-shaped material W is set to the bending apparatus 3. FIG. 9 illustrates a time when the bending process to the plate-shaped material W has been completed.

"x1" of FIG. 10 indicates a bending area of the near side in x-direction of the plate-shaped material W. "x2" of FIG. 10 indicates a bending area of the far side in x-direction of the plate-shaped material W.

The bending apparatus 3 includes a plurality of a first processing device and a plurality of a second processing device whose number of processing device is one less than that of the first processing device on the near side (bending area x1). The bending apparatus 3 includes at least two first processing devices and at least one second processing device on the far side (bending area x2).

In FIGS. 8 and 9, the bending apparatus 3 includes a plurality of punch units PU (for example, punch unit PU7-punch unit PU14) for bending the plate-shaped material W by pressing the plate-shaped material W with punch P and die D. Punch units PU12, PU13 and PU14 are disposed on the far side (bending area x2) in the x-direction of the plate-shaped material W and disposed at different positions in y-direction. Punch units PU7, PU8, PU9, PU10 and PU11 are disposed on the near side (bending area x1) in the x-direction of the plate-shaped material W and disposed at different positions in y-direction.

A plurality of punch units PU (for example, punch unit PU7-punch unit PU11 and punch unit PU12-punch unit PU14), which is disposed in the bending area x1 and bending area x2 in the y-direction, is arranged so that the bending direction of punch P and die D of each punch unit to the surface of the plate-shaped material W becomes opposite of each other.

In the bending area x1, the plurality of punch units is arranged so that the bending direction of the punch unit against the plate-shaped material W is opposite of that of the adjacent punch unit. For example, in the bending area x1, the die D8 and the punch P8 of the punch unit PU8 are disposed on the surface $W_1$ side and on the surface $W_2$ side, respectively, in respect to the punch P7 and the die D7 of the punch unit PU7, which are disposed on the surface $W_1$ side and on the surface $W_2$ side, respectively. Also, the punch P9 and the die D9 of the punch unit PU9 are disposed on the surface $W_1$ side and on the surface $W_2$ side, respectively, in respect to the die D8 and the punch P8 of the punch unit PU8, which are disposed on the surface $W_1$ side and on the surface $W_2$ side, respectively. Also, the die D10 and the punch P10 of the punch unit PU10 are disposed on the surface $W_1$ side and on the surface W2 side, respectively, in respect to the punch P9 and the die D9 of the punch unit PU9, which are disposed on the surface $W_1$ side and on the surface $W_2$ side, respectively. And in the similar manner, the punch P11 and the die D11 of the punch unit PU11 are disposed on the surface $W_1$ side and on the surface $W_2$ side, respectively, in respect to the die D10 and the punch P10 of the punch unit PU10, which are disposed on the surface $W_1$ side and on the surface $W_2$ side, respectively. In the bending area x2, the die D13 and the punch P13 of the punch unit PU13 are disposed on the surface $W_1$ side and on the surface $W_2$ side, respectively, in respect to the punch P12 and the die D12 of the punch unit PU12, which are disposed on the surface $W_1$ side and on the surface $W_2$ side, respectively. Also, the punch P14 and the die D14 of the punch unit PU14 are disposed on the surface $W_1$ side and on the surface $W_2$ side, respectively, in respect to the die D13 and the punch P13 of the punch unit PU13, which are disposed on the surface $W_1$ side and on the surface $W_2$ side, respectively.

That is, the punch units PU12, PU7, PU9, PU11 and PU14 being the first processing devices are capable of bending one surface of the plate-shaped material W to not more than 180 degrees by pressing the plate-shaped material W. The punch units PU8, PU13 and PU10 being the second processing device are capable of bending the other surface of the plate-shaped material W to not more than 180 degrees by pressing the plate-shaped material W.

With the configuration described above, the bending area x1 and the bending area x2 of the plate-shaped material W are bent so that the bending direction of each of the bending area opposes each other.

A moving device 1023, which enables the punch P12 to move in the y-direction and the t-direction simultaneously, is connected to the punch P12 of the punch unit PU12. A moving device 1024, which enables the die D12 to move in the y-direction and the t-direction simultaneously, is connected to the die D12 of the punch unit PU12. Moving devices 1025 and 1026, which enable the punch P13 and the die D13 to move in the y-direction and the t-direction simultaneously, are connected to the punch P13 and the die D13 of the punch unit PU13. In the same manner, moving devices 1027 and 1028, which enable the punch P14 and the die D14 to move in the y-direction and the t-direction simultaneously, are connected to the punch P14 and the die D14 of the punch unit PU14.

A moving device 1013, which enables the punch P7 to move in the y-direction and the t-direction simultaneously, is connected to the punch P7 of the punch unit PU7. A moving device 1014, which enables the die D7 to move in the y-direction and the t-direction simultaneously, is connected to the die D7 of the punch unit PU7. In the similar manner, moving devices 1015 and 1016, which enable the punch P8 and the die D8 to move in the y-direction and the t-direction simultaneously, are connected to the punch P8 and the die D8 of the punch unit PU8. Moving devices 1017 and 1018, which enable the punch P9 and the die D9 to move in the y-direction and the t-direction simultaneously, are connected to the punch P9 and the die D9 of the punch unit PU9. Moving devices 1019 and 1020, which enable the punch P10 and the die D10 to move in the y-direction and the t-direction simultaneously, are connected to the punch P10 and the die D10 of the punch unit PU10. Moving devices 1021 and 1022, which enable the punch P11 and the die D11 to move in the y-direction and the t-direction simultaneously, are connected to the punch P11 and the die D11 of the punch unit PU11.

The punches P7, P8, P9, P10 and P11 and the dies D7, D8, D9, D10 and D11 disposed on the near side have the length that is the same as the width of the bending area x1 in x-direction or the length that is not less than the width of the bending area x1 in x-direction. The punches P12, P13 and P14 and the dies D12, D13 and D14 disposed on the far side have the length that is the same as the width of the bending area x2 in x-direction or the length that is not less than the width of the bending area x2 in x-direction.

The far side edges (not illustrated) of the punches P7, P8, P9, P10 and P11 and the dies D7, D8, D9, D10 and D11 disposed on the near side come slidably in contact with the near side edges (not illustrated) of the punches P12, P13 and P14 and the dies D12, D13 and D14 disposed on the far side.

Far side edges (not illustrated) of the leading edge sections of the punches P7, P8, P9, P10 and P11 and the dies D7, D8, D9, D10 and D11 are arranged to be an edge of not more than 90 degrees. Also near side edges (not illustrated) of the leading edge sections of the punches P12, P13 and P14 and the dies D12, D13 and D14 are arranged to be an edge of not more than 90 degrees. The punches and the dies are moved in the t-direction. By sliding the above mentioned edges of the punches and the dies disposed on the bending area x2 and of the punches and the dies disposed on the bending area x1, the plate-shaped material is cut. Then a slit is formed on the plate-shaped material W.

It becomes possible to separate the plate-shaped material W into the bending area x1 and the bending area x2 by this slit. A distortion of the plate-shaped material W by a mutual interference of the bending processes in the bending area x1 and the bending area x2 can be prevented with this slit.

With regards to a description of a processing method, a control device not illustrated controls the bending apparatus 2 so that each of a plurality of moving devices in the bending area x2 (for example, moving devices 1023-1028) and each of a plurality of moving devices in the bending area x1 (for example, moving devices 1013-1022) move in response to each other.

The value of the bending angle θ, for example, θ7, θ13 and θ14, which is formed by two surfaces (for example, surfaces w9 and w10, surfaces w10 and w17 and surfaces w17 and w18), that sandwich a ridge (for example, ridges r12, r13 and r14) being a bent section O bent by a plurality of pairs of the punch P and the die D (for example, the punch P12 and the die D12, the punch P13 and the die D13 and the punch P14 and the die D14) disposed in the bending area x2, is maintained the same during the bending process. The value of the bending angle θ (for example, θ8, θ9, θ10, θ11 and θ12), which is formed by two surfaces (for example, surfaces W11 and W12, surfaces W12 and W13, surfaces W13 and W14, surfaces W14 and W15 and surfaces W15 and W16) that sandwich a ridge (for example, ridges r7, r9, r10 and r11) being a bent section O bent by a plurality of pairs of the punch P and the die D (for example, the punch P7 and the die D7, the punch P8 and the die D8, the punch P9 and the die D9, and the punch P10 and the die D10 and the punch P11 and the die D11) disposed in the bending area x1, is maintained the same during the bending process. Also the surfaces (for example, surfaces w10, w12, w14, w16 and w18 and surfaces w17, w8, w11, w13 and w15) of the plate-shaped material or the extended surface of those surfaces that become parallel to each other at the time of completion of the bending process are maintained to be parallel to each other at all times during the bending process. Moving in response to each other refers to controlling and relatively moving the punch and the die, for example, punch P7 to punch P14 and die D7 to die D14 in the t-direction and the y-direction, in response to each other so that the plate-shaped material W (for example, surfaces w12-w15), which is arranged between, for example, the punch unit PU7 and the punch unit PU8, the punch unit PU8 and the punch unit PU9, the punch unit PU9 and the punch unit PU10 and the punch unit PU10 and the punch unit PU11 disposed adjacent to each other in the y-direction in the bending area x1, and so that the plate-shaped material W (for example, surfaces w10 and w17), which is arranged between the punch unit PU12 and the punch unit PU13 and the punch unit PU13 and the punch unit PU14 disposed adjacent to each other in the y-direction in the bending area x2, maintains a fair surface (straight line in the figure) during the bending process.

That is, a bending angle θ (for example, θ8, θ9, θ10, θ11 and θ12) of each bending section O of the plate-shaped material W is maintained to an equal value at all times during the bending process. Also, surfaces or extended surfaces of the plate-shaped material W, which become mutually parallel at the time of completion of the bending process, are held parallel at all times during the bending process. Hence, the plate-shaped material placed between the punch units collaterally arranged in the y-direction can maintain a fair surface (straight line in the illustration) at all times during the bending process. Therefore, all of the punches P and the dies D of the punch units collaterally arranged in the y-direction are controlled to relatively move in the t-direction and the y-direction.

As described above, a bending process is performed to a plurality of places on the plate-shaped material by moving the punch P7 and die D7-the punch P14 and die D14 in response to each other and relatively moving the punch P7 and die D7-the punch P14 and die D14 to the t-direction and y-direction, respectively. That is, a bending process to a plurality of places can be performed in one process. Therefore, productivity can be improved, and reduction of strength of the completed parts can be prevented without stretching the material just as in a drawing process.

A bent sheet metal part having an arbitrary bending angle θ that is less than 180 degrees can be processed by arranging a leading edge section of the punch P7-punch P14 with a triangle-shaped convex section having less than 180 degree angle on a leading edge section and by arranging a leading edge section of the die D3-die D6 with a triangle-shaped concave section having less than 180 degree angle on the trough just as in the punch P3-punch P6.

A bent sheet metal A3 having 90 degree of a bending angle θ as illustrated in FIG. 10 can be processed by arranging a leading edge section of the punch P7-punch P14 with a triangle-shaped convex section having 90 degree angle on a leading edge section and by arranging the leading edges of the die D7-die D14 with a triangle-shaped concave section having 90 degree angle on the trough just as in the punch P7-punch P14.

It is desirable that the shape of the leading edge section (convex section of a triangle-shape) of all the punches P is the same, and the shape of the leading edge section (concave section of a triangle-shape) of all the die D is the same. In this case, starting time of the movement of all the punches P and dies D is set to the same time, and speed of the movement of all the punches P and dies D can be set to the same speed. Thus, the control can be simplified.

A configuration in which three punch units are arranged in the bending area x2 has been described above. However, it is needless to mention that not less than three punch units may be arranged in the bending area x2.

By configuring the bending apparatus 3 with the above described configuration, in addition to the effect from the configuration described in reference with FIGS. 5 and 6, a plate-shaped material bending apparatus, which can produce a bent sheet metal having a convex section projected in the opposite direction on the front and the back surface of the plate-shaped material W in the bending area x1 and the bending area x2, can be provided.

Figure 11:
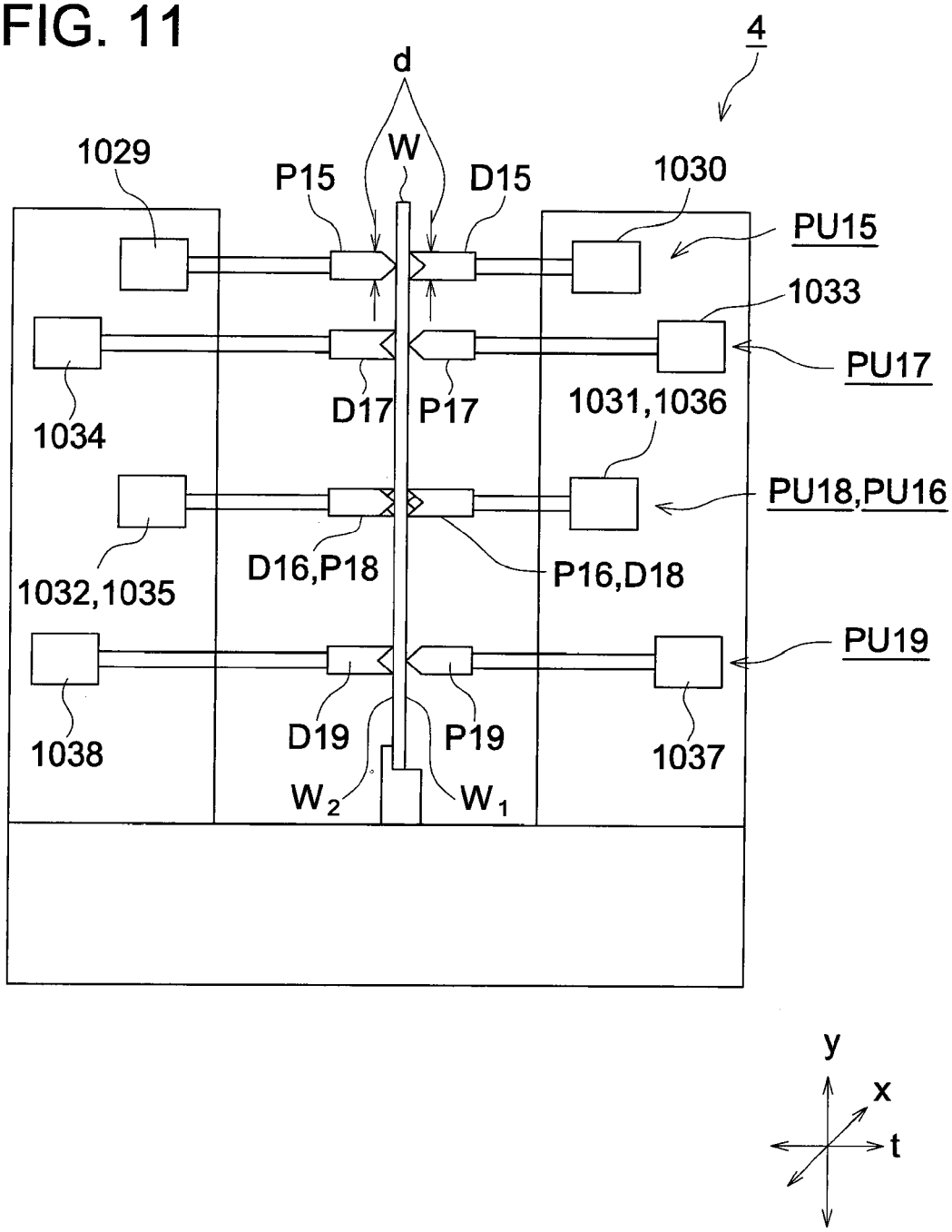
FIG. 11 is an explanatory diagram of a fourth example of a bending apparatus to carry out different bending works in a back side and a front side in a x direction of the plate-shaped material W by biasing a punch P and a died through a motor.
Figure 12:
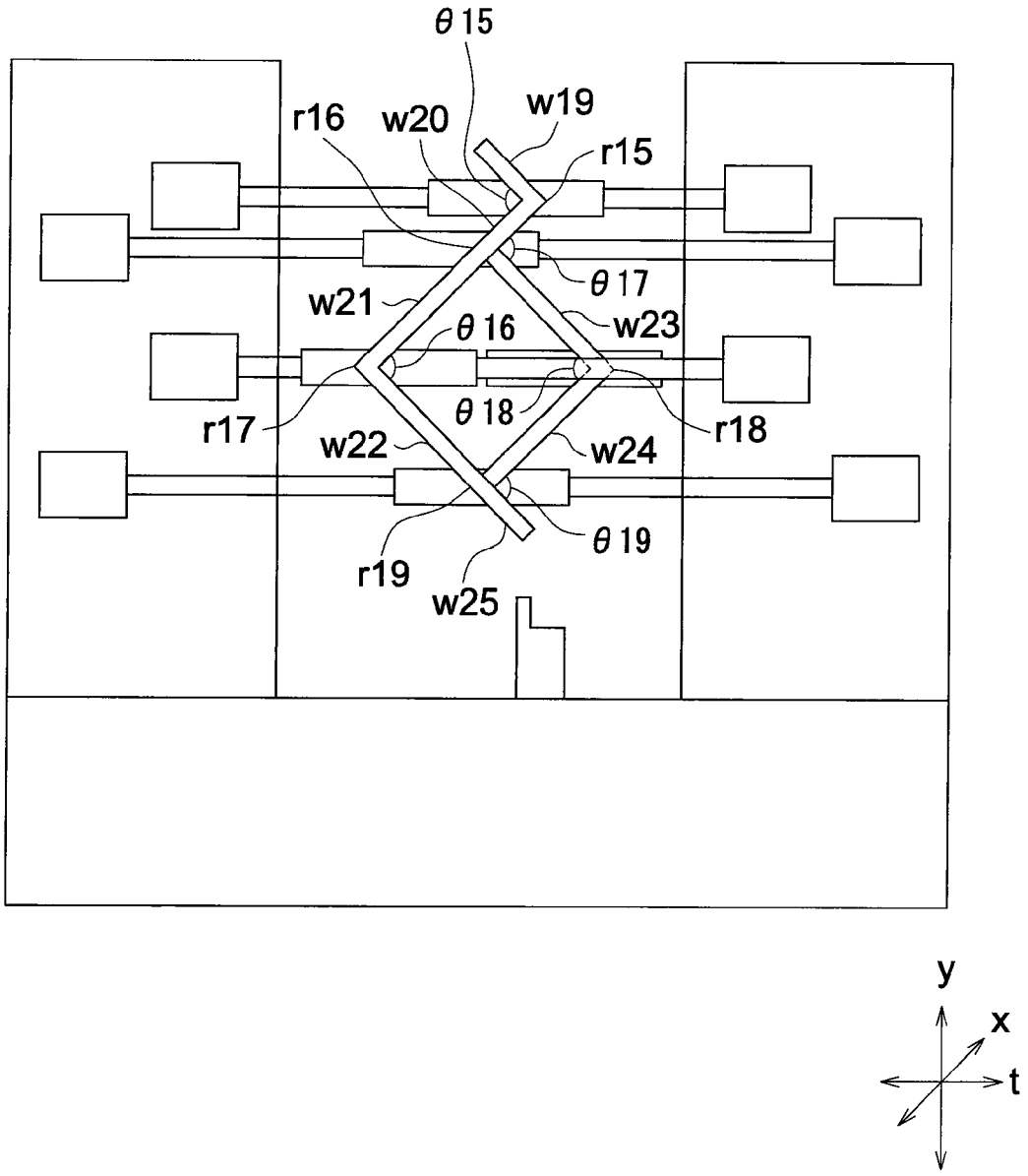
FIG. 12 is an explanatory diagram of a fourth example of a bending apparatus to carry out different bending works in a back side and a front side in a x direction of the plate-shaped material W by biasing a punch P and a died through a motor.
Figure 13:
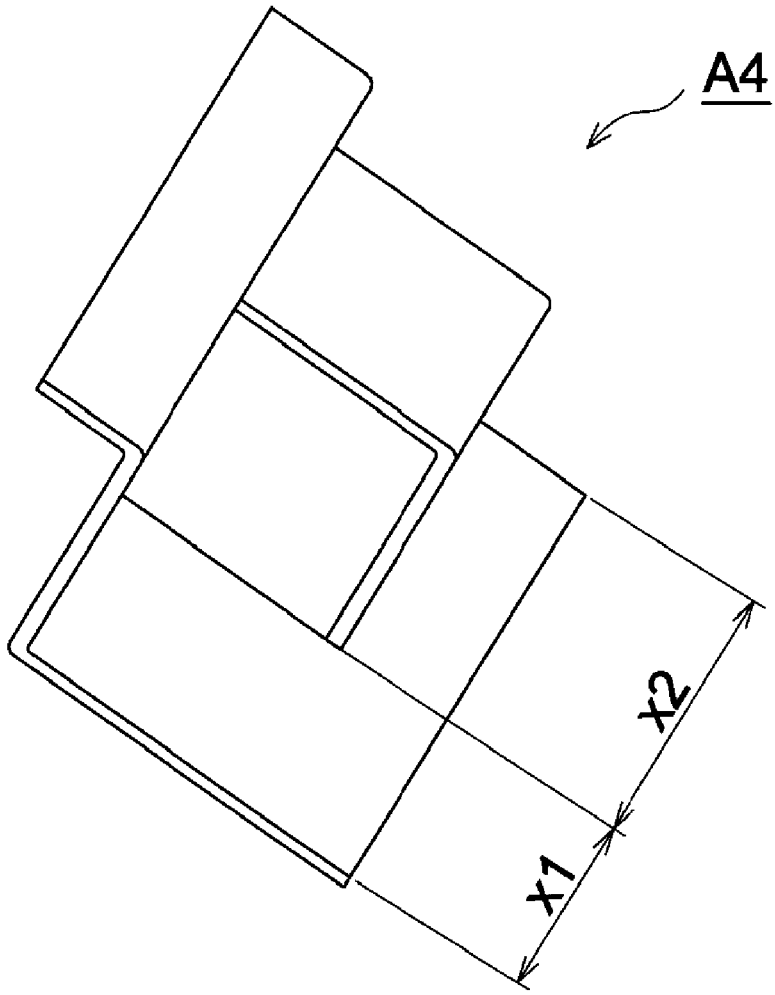
FIG. 13 is a perspective view of a part having been subject to different bending works in a back side and a front side with respect to a x direction representing a third direction which is perpendicular to both a first direction (t direction) and a second direction (y direction) which is perpendicular to the t direction.

FIGS. 11 and 12 illustrate explanatory diagrams of a fourth example of a bending apparatus for energizing the punch P and the die D with a motor and bending the near side and the far side in the x-direction of the plate-shaped material differently. FIG. 13 illustrates a perspective view of a part onto which a different bending process is performed on the near side and the far side in the x-direction being a third direction, which is perpendicular to a first direction (t-direction) and a second direction (y-direction) which is perpendicular to the t-direction.

In detail, FIG. 11 illustrates the time when the plate-shaped material W is set in the bending apparatus 4. FIG. 12 illustrates the time when the bending process to the plate-shaped material W has been completed.

FIG. 13 illustrates the part onto which a different bending process is performed on the near side and the far side in the x-direction being a third direction, which is perpendicular to a first-direction (t-direction) and a second direction (y-direction) which is perpendicular to the t-direction.

"x1" of FIG. 13 indicates a bending area of the near side in the x-direction of the plate-shaped material W. "x2" of FIG. 13 indicates a bending area of the far side in the x-direction of the plate-shaped material W.

The bending apparatus 4 has one first processing device in the near side (bending area x1) of the plate-shaped material W, two first processing devices and one second processing device in the far side (bending area x2) of the plate-shaped material W.

In FIGS. 11 and 12, the bending apparatus 4 has a plurality of punch units PU (for example, punch unit PU15-punch unit PU19) for bending and pressing the plate-shaped material W with the punch P and the die D.

The punch unit PU15 covering the full width of the plate-shaped material W is disposed on the upper section of the other punch units in the figure. The punch units PU17, PU18 and PU19 are collaterally disposed in the y-direction on the far side in the x-direction of the plate-shaped material W (bending area x2). The punch unit PU16 is disposed in the y-direction on the near side in the x-direction of the plate-shaped material W (bending area x1).

Here, a plurality of punch units PU (for example, punch units PU15-PU19) is arranged so that the bending direction against the plate-shaped material W becomes opposite of that of the adjacent punch units. With regards to the spatial relationship of each of the punch P and the die D to the surface of the plate-shaped material W, for example, in the bending area x1, the punch P16 of the punch unit PU16 is disposed on the surface $W_1$ side and the die D16 is disposed on the surface $W_2$ side with respect to the die D15 of the punch unit PU15 being disposed on the surface $W_1$ side and the punch P15 of the punch unit PU15 being disposed on the surface $W_2$ side. In the bending area x2, the punch P17 of the punch unit PU17 is disposed on the surface $W_1$ side and the die D17 of the punch unit PU17 is disposed on the surface $W_2$ side with respect to the die D15 of the punch unit PU15 being disposed on the surface $W_1$ side and the punch P15 of the punch unit PU15 being disposed on the surface $W_2$ side. Also, the die D18 of the punch unit PU18 is disposed on the surface $W_1$ side and the punch P18 of the punch unit PU18 is disposed on the surface $W_2$ side with respect to the die D17 of the punch unit PU17 being disposed on the surface $W_1$ side and the Punch P17 of the punch unit PU17 being disposed on the surface $W_2$ side. Also, the punch P19 of the punch unit PU19 is disposed on the surface $W_1$ side and the die D19 of the punch unit PU19 is disposed on the surface $W_2$ side with respect to the die D18 of the punch unit PU18 being disposed on the surface $W_1$ side and the punch P18 of the punch unit PU18 being disposed on the surface $W_2$ side.

That is, the punch units PU17, PU16 and PU19 being the first processing device are capable of bending one surface of the plate-shaped material W to not more than 180 degrees by pressing the plate-shaped material W. The punch units PU15 and PU18 being the second processing device are capable of bending the other surface of the plate-shaped material W to not more than 180 degrees by pressing the plate-shaped material W.

Thereby, the plate-shaped material W has a convex section in each of the bending area x1 and the bending area x2 whose projected direction oppose each other.

A moving device 1029, which enables the punch P15 to move in the y-direction and the t-direction simultaneously, is connected to the punch P15 of the punch unit PU15. A moving device 1030, which enables the die D15 to move in the y-direction and the t-direction simultaneously, is connected to the die D15 of the punch unit PU15.

A moving device 1033, which enables the punch P17 to move in the y-direction and the t-direction simultaneously, is connected to the punch P17 of the punch unit PU17. A moving device 1030, which enables the die D17 to move in the y-direction and the t-direction simultaneously, is connected to the die D75 of the punch unit PU17.

In the similar manner, moving devices 1031 and 1032, which enable the punch P16 and the die D16 to move in the y-direction and the t-direction simultaneously, is connected to the punch P16 and the die D16 of the punch unit PU16. Moving devices 1035 and 1036, which enable the punch P18 and the die D18 to move in the y-direction and the t-direction simultaneously, is connected to the punch P18 and the die D18 of the punch unit PU18. Moving devices 1037 and 1038, which enable the punch P19 and the die D19 to move in the y-direction and the t-direction simultaneously, is connected to the punch P19 and the die D19 of the punch unit PU19.

The punch P15 and the die D15 have the length that is the same as the width of the plate-shaped material W or the length that is not less than the width of the plate-shaped material W in the x-direction. The punch P16 and the die D16 disposed on the near side have the length that is the same as the width of the bending area x1 or the length that is not less than the width of the bending area x1 in the x-direction. The punches P17, P18 and P19 and the dies D17, D18 and D19 disposed on the far side have the length that is the same as the width of the bending area x2 or the length that is not less than the width of the bending area x1 in x-direction.

The far side edges (not illustrated) of the punch P16 and the die D16 disposed on the near side come slidably in contact with the near side edges (not illustrated) of the punches P17, P18 and P19 and the dies D17, D18 and D19 disposed on the far side. Far side edges (not illustrated) of the leading edge sections of the punch P16 and the die D16 are arranged to be an edge of not more than 90 degrees. Also near side edges (not illustrated) of the leading edge sections of the punches P17, P18 and P19 and the dies D17, D18 and D19 are arranged to be an edge of not more than 90 degrees. The punches and the dies are moved in the t-direction. By sliding the above mentioned edges of the punches and the dies disposed on the bending area x2 and of the punches and the dies disposed on the bending area x1, the plate-shaped material is cut. Then a slit is formed on the plate-shaped material W.

Since this slit separates the plate-shaped material W into the bending area x1 and the bending area x2, a distortion of the plate-shaped material W by a mutual interference of the bending in the bending area x1 and the bending area x2 can be prevented with this slit.

With regards to the description of a processing method, a non-illustrated control device controls a plurality of moving devices, for example, the moving devices 1029-1038, so that the plurality of moving devices moves in response to each other.

Here, moving in response to each other refers to as following.

The value of the bending angle θ, for example, θ15, θ17, θ18 and θ19, which is formed by two surfaces (for example, surfaces w19 and w20, surfaces w20 and w23, surfaces w23 and w24 and surfaces w24 and w2), that sandwich a ridge (for example, ridges r15, r16, r18 and r19) being a bent section O bent by a plurality of pairs of the punch P and the die D (for example, the punch P15 and the die D15, the punch P16 and the die D16, the punch P18 and the die D18 and the punch P19 and the die D19) disposed in the bending area x2, is maintained the same during the bending process. The value of the bending angle θ (for example, θ15 and θ16), which is formed by two surfaces (for example, surfaces w19 and w20 and surfaces w21 and w22), that sandwich a ridge (for example, ridges r15 and r17) being a bent section O bent by a plurality of pairs of the punch P and the die D (for example, the punch P15 and the die D15 and the punch P17 and the die D17) disposed in the bending area x1, is maintained the same during the bending process. Also the surfaces (for example, surfaces w19, w23, w22 and w25 and surfaces w20 (w21) and w24) of the plate-shaped material that become parallel to each other at the time of completion of the bending process or the extended surface of those surfaces are maintained to be parallel to each other at all times during the bending process. Hence, moving in response to each other refers to controlling and relatively moving the punch and the die, for example, punch P15 to punch P19 and die D15 to die D19, in the t-direction and the y-direction in response to each other so that the plate-shaped material W (for example, surfaces w20 and w21), which is arranged between the punch unit PU15 and the punch unit PU17 disposed adjacent to each other in the y-direction in the bending area x1, and the plate-shaped material W (for example, surfaces w20, w23 and w24), which is arranged between the punch unit PU15 and the punch unit PU16, the punch unit PU16 and the punch unit PU18 and the punch unit PU18 and the punch unit PU19 disposed adjacent to each other in the y-direction in the bending area x2, maintains a fair surface (straight line in the figure) during the bending process.

As described above, a bending is performed on a plurality of places on the plate-shaped material by moving the punch P15 and die D15-the punch P19 and die D19 in response to each other and relatively moving the punch P15 and die D15-the punch P19 and die D19 to the t-direction and y-direction, respectively. That is, a bending on a plurality of places can be performed in one process. Therefore, productivity can be improved, and reduction of strength of the completed parts can be prevented without stretching the material just as in a drawing process.

By configuring the bending apparatus 3 with the above described configuration, in addition to the effect from the configuration described in reference with FIGS. 5 and 6, a plate-shaped material bending apparatus, which can produce a bent sheet metal part A4 having a convex section projected in the opposite direction on the front and the back surface of the plate-shaped material W in the bending area x1 and the bending area x2 and a flange (surface W19), can be provided.

The punch unit PU15 can be removed from the configuration described above. In this case, a plate-shaped material bending apparatus that is capable of producing a bent sheet metal (not illustrated), which has a convex section projected in the opposite direction on the front and the back side of the plate-shaped material W in the bending area x1 and the bending area x2, can be provided.

A bent sheet metal part having an arbitrary bending angle θ that is less than 180 degrees can be processed by arranging a leading edge section of the punch P15-punch P19 with a triangle-shaped convex section having not more than 180 degree angle on a leading edge section and by arranging a leading edge section of the die D15-die D19 with a triangle-shaped concave section having not more than 180 degree angle on the trough just as in the punch P15-punch P19.

A bending angle θ of 90 degrees as illustrated in FIG. 13 can be realized by arranging a leading edge section of the punch P15-punch P19 with a triangle-shaped convex section having 90 degree angle on a leading edge section and by arranging the leading edges of the die D15-die D19 with a triangle-shaped concave section having 90 degree angle on the trough just as in the punch P15-punch P19.

It is desirable that the shape of the leading edge section (convex section of a triangle-shape) of all the punches P is the same, and the shape of the leading edge section (concave section of a triangle shape) of all the die D is the same. In this case, starting time of the movement of all the punches P and dies D is set to the same time, and speed of the movement of all the punches P and dies D can be set to the same speed. Thus, the control can be simplified.

Figure 14:
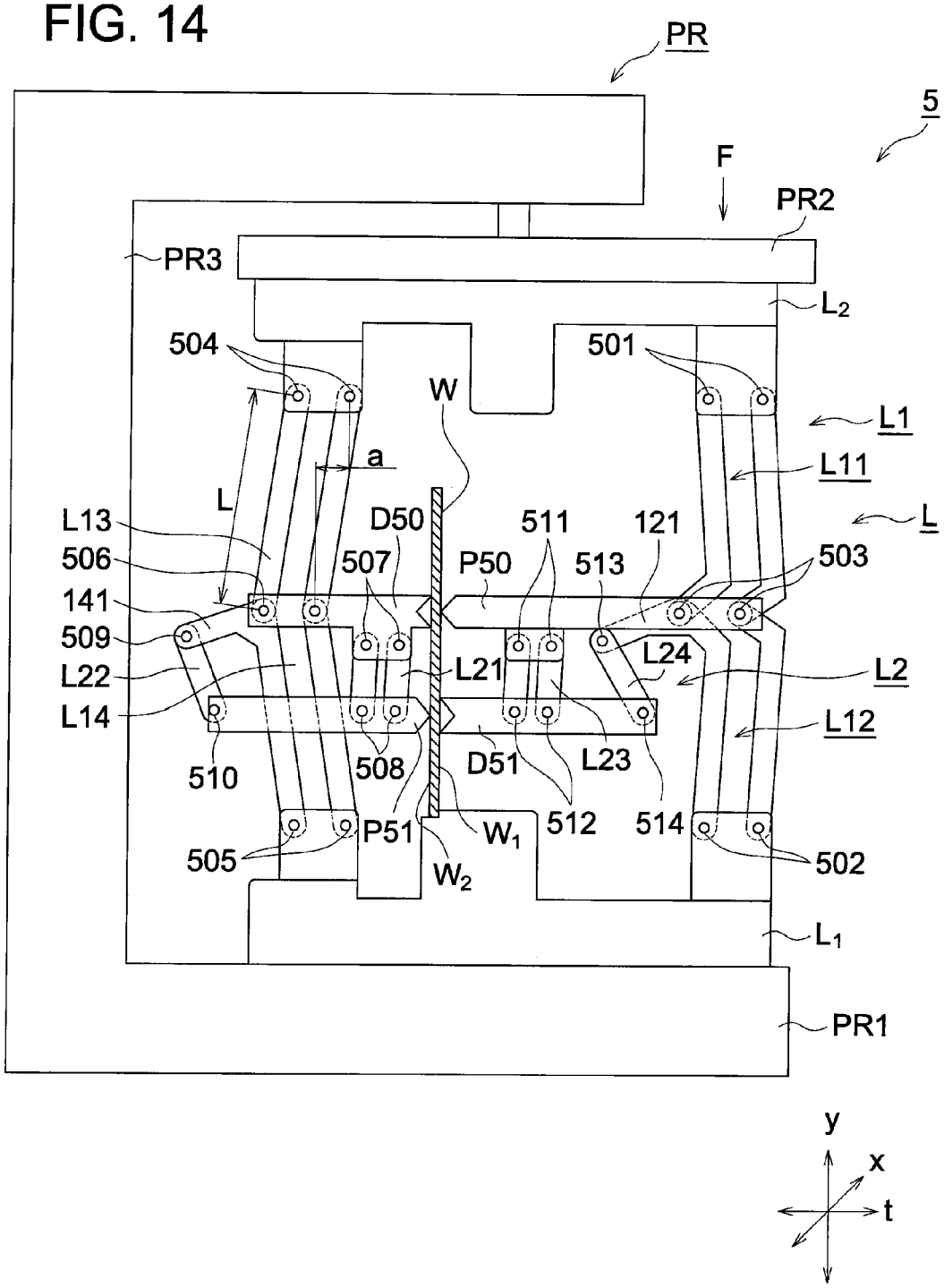
FIG. 14 is an explanatory diagram of a fifth example of a bending apparatus which bends a plate-shaped material W by biasing a punch P and a die D via a link mechanism.
Figure 15:
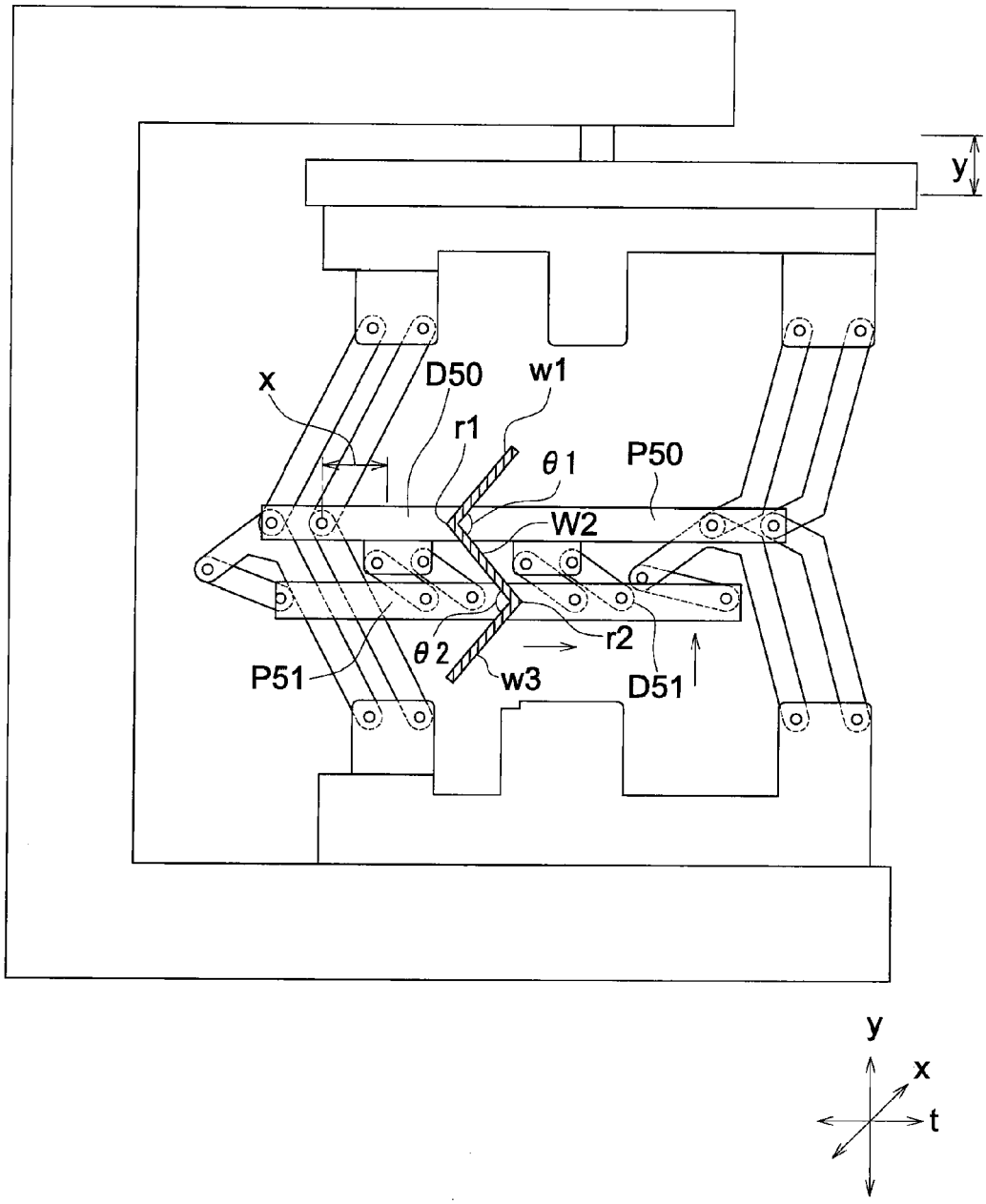
FIG. 15 is an explanatory diagram of a fifth example of a bending apparatus which bends a plate-shaped material W by biasing a punch P and a die D via a link mechanism.
Figure 16:
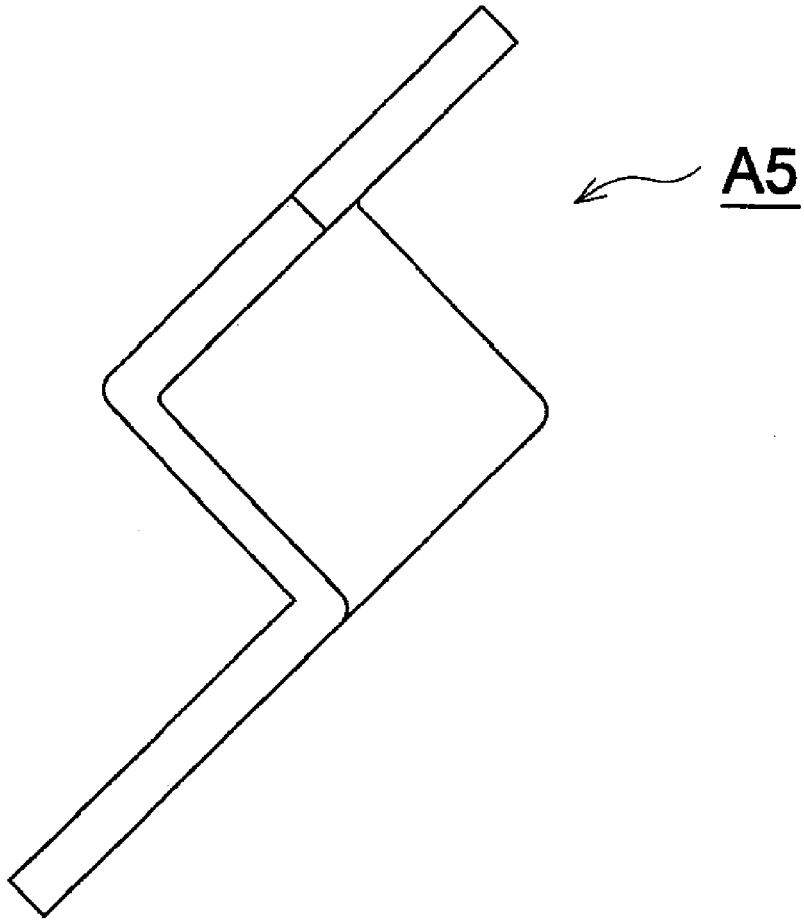
FIG. 16 is a perspective view of a part having been subject to bending work by pressing a plate-shaped material W by a bending apparatus 5.

FIGS. 14 and 15 illustrate explanatory diagrams of a fifth example of a bending apparatus, which energizes the punch P and the die D via a linkage mechanism and bends the plate-shaped material W. FIG. 16 illustrates a perspective view of a part onto which a bending process has been performed by having the bending apparatus 5 press the plate-shaped material W.

In detail, FIG. 14 illustrates the time when the plate-shaped material W has been set to the bending apparatus 5. FIG. 15 illustrates the time when the bending process to the plate-shaped material. W has been completed.

In FIGS. 14 and 15, the bending apparatus 5 is configured by a link section L, which press and bends the plate-shaped material W, and a press section PR, which serves as a bending driving force. For example, a press machine, which uses oil pressure and is usually employed, can be used for the press section PR. The press section PR includes a pedestal PR1, which fixes and holds the link section L, a moving pedestal PR2, which is capable of moving in up and down direction of the illustration with respect to the pedestal PR1, and a main body PR3, which moves the moving pedestal PR2 up and down with oil pressure.

A pedestal $L_1$ of the link section L is fixed onto the pedestal PR1. A moving pedestal $L_2$ of the link section is fixed onto the moving pedestal PR2. The bending apparatus 5 is configured so that the bending to the plate-shaped material W can be performed by lowering the moving pedestal $L_2$ for a predetermined distance with the lowering of the moving pedestal PR2.

The link section L has a plurality of linkage mechanisms, which bends the plate-shaped material W with the punch and the die. For example, the link section includes a linkage mechanism $L_1$, which is equivalent to the first processing device, and a linkage mechanism L2, which is equivalent to the second processing mean. The linkage mechanism $L_1$ is provided between the pedestal $L_1$ and a moving pedestal $L_2$. The linkage mechanism L2 is provided on a punch P50 and a die D50.

The linkage mechanism $L_1$ includes a first link L11 and a second link L12, which move the punch 50 in y-direction and t-direction as drawing a circle while maintaining parallel with respect to the pedestal $L_1$, and a third link L13 and a fourth link L14, which move the die D50 in y-direction and t-direction as drawing a circle while maintaining a parallel with respect to the pedestal $L_1$. Each of the first link L11, the second link L12, the third link L13 and the fourth link L14 are configured by a pair of parallel links.

The linkage mechanism L2 includes a fifth link L21, which moves the punch 51 in y-direction and t-direction as drawing a circle while maintaining parallel with respect to the die D50, a seventh link L23, which energizes the punch P51, a seventh link L23, which moves the die D51 in y-direction and t-direction as drawing a circle while maintaining parallel with respect to the punch P50, and an eighth link L24, which energizes the die D51. The fifth link L21 and the sixth link L23 are configured by a pair of parallel links.

The linkage mechanism L2 moves the punch 51 and the die 51 to reduce the interval of the die 51 and the punch 51 with respect to the punch 50 and the die D50 in y-direction while reducing the interval of the punch P51 and the die D51 in t-direction.

A plurality of punch units disposed adjacent to each other in y-direction, (for example, the set of the punch P50 and the die D50, and the set of the punch P51 and the die D51) is arranged so that the bending direction of the punch unit to the surface of the plate-shaped material opposes from that of the adjacent punch unit. For example, the punch units are arranged so that the die D51 is disposed on the surface W1 side and the punch P51 is disposed on the surface $W_2$ side with respect to the punch P50 disposed on the surface W1 side and the die D50 disposed on the surface $W_2$ side.

That is, the punch P50 and the die D50 being the first processing device are capable of bending one surface of the plate-shaped material W to not more than 180 degrees by pressing the plate-shaped material W. The punch P51 and the die D51 being the second processing device are capable of bending the other surface of the plate-shaped material W to not more than 180 degrees by pressing the plate-shaped material W.

By utilizing a bending apparatus having the above described configuration, a bending process, which bends the plate-shaped material W into a Z shape, is performed on the plate-shaped material W.

The punch P50 and the die D50, and the punch P51 and the die D51 have a length that is the same as the width of the plate-shaped material W in the x-direction or a length that is not less than the width of the plate-shaped material W in the x-direction.

The linkage mechanism L1 will be described in detail. One end of the first link L11 is pivotally fixed onto a moving pedestal $L_2$ by a pivot 501. The other end of the first link L11 is pivotally fixed onto the punch P50 by a pivot 503. One end of the second link L12 is pivotally fixed onto the pedestal $L_1$ by a pivot 502. The other end of the second link L12 is pivotally fixed onto the punch P50 by a pivot 503.

The first link L11 and the second link L12 enable the punch P50 to move as drawing a circle while maintaining parallel to the pedestal $L_1$. With regards to the spatial relationship of pivots of the first link L11 and the second link L12, since the punch P50 moves to the leading edge side in response with the movement of the moving pedestal $L_2$, in the t-direction, the pivots 501 and the pivots 502 are arranged on a straight line parallel to the y-axis and the pivots 503 is arranged on the right-hand side of the straight line in the figure.

In case when the moving pedestal PR2 descends, the first link L11 and the second link L12 moves the punch P50 towards the leading edge side and the lower side of the figure as drawing a circle while maintaining a parallel to the pedestal $L_1$.

One end of the third link L13 is pivotally fixed onto a moving pedestal $L_2$ by a pivot 504. The other end of the third link L13 is pivotally fixed onto the punch D50 by a pivot 506. One end of the fourth link L14 is pivotally fixed onto the pedestal $L_1$ by a pivot 505. The other end of the fourth link L14 is pivotally fixed onto the punch D50 by a pivot 506.

The third link L13 and the fourth link L14 enables the die D50 to move as drawing a circle while maintaining a parallel to the pedestal $L_1$. With regards to the spatial relationship of pivots of the third link L13 and the fourth link L14, since the die D50 moves to the opposite direction of the leading edge side, in the t-direction, the pivots 504 and the pivots 505 are arranged on a straight line parallel to the y-axis and the pivots 506 is arranged on the left-hand side of the straight line in the figure.

In case when the moving pedestal PR2 descends, the third link L13 and the fourth link L14 move the die D50 into the opposite direction of the leading edge side and the lower side of the figure as drawing a circle while maintaining a parallel to the pedestal $L_1$.

In response to the movement of the punch P50 and the die D50, the leading edges of the punch P50 and the die D50 come in contact with each other via the plate-shaped material W and the surface $W_1$ of the plate-shaped material W is bent to not more than 180 degrees.

The linkage mechanism L2 will be described in detail. One end of the fifth link L21 is pivotally fixed onto the die D50 by a pivot 507. The other end of the fifth link L21 is pivotally fixed onto the punch P51 by a pivot 508. The fifth link L21 enables the punch P51 to move as drawing a circle while maintaining a parallel to the die D50. Then, the punch P51 is moved to the leading edge. Therefore, one end of the sixth link L22 is pivotally fixed onto a pivot 509 of the projection section 141 of the fourth link L14 and the other end of the sixth link L22 is pivotally fixed onto a pivot 510 of the punch P51.

In case when the moving pedestal PR2 descends, the fifth link L21 and the sixth link L22 move the punch P51 toward the leading edge so as to reduce the separation distance to the die 50 as drawing a circle while maintaining a parallel to the die D50.

One end of the seventh link L23 is pivotally fixed onto the punch P50 by a pivot 511. The other end of the seventh link L23 is pivotally fixed onto the die D50 by a pivot 512. The seventh link 123 enables the die D51 to move as drawing a circle while maintaining a parallel to the punch P50. Then the die D51 is energized to the opposite side of the leading edge. Therefore, one end of the eighth link L24 is pivotally fixed onto a pivot 513 of a projection section 121 of the first link L11 and the other end of the eighth link L24 is pivotally fixed onto a pivot 514 of the die D51.

In case when the moving pedestal PR2 descends, the seventh link L23 and the eighth link L24 moves the die D51 into the opposite direction of the leading edge so as to reduce the interval to the punch 50 in the y-direction while maintaining a parallel to the punch P50.

A relative movement amount of the punch P51 and the die D51 in the t-direction is the amount in which the leading edges of the punch P51 and the die D51 comes in contact with each other via the plate-shaped material W. The movement of the punch P51 and the die D51 bends the surface $W_2$ of the plate-shaped material W to not more than 180 degrees.

As described above, the punch P51 moves according to the movement of the die D50 via the fifth link 121 and the sixth link L22. The die D51 moves according to the movement of the punch P50 via the seventh link L23 and the eighth link L24. Hence, a plurality of punch units (for example, a set of punch P50 and the die D50 and a set of punch P51 and the die D51) can move in response to each other.

That is, the movement of the punch P50 and the die D50 bends the surface $W_1$ of the plate-shaped material W to not more than 180 degrees. By moving the punch P51 and the die D51 in response to (in accordance to) the movement of the punch P50 and the die D50, the surface $W_2$ of the plate-shaped material W is bent to not more than 180 degrees. Hence, a Z-shaped bending is realized.

In the configuration above, the value of the bending angle θ, for example, θ1 and θ2, which are formed by surfaces, for example, surfaces w1 and w2 and surfaces w2 and w3, that sandwich a ridge, for example, a ridges r1 and r2, being a bent section bent by the punch P and the die D, is maintained the same value during the bending process. Also the surfaces of the plate-shaped material (for example, surfaces w1 and w3) that become parallel to each other at the time of completion of the bending process or the extended surface of those surfaces are maintained to be parallel to each other at all times during the bending process. Hence, in order to have all of the plate-shaped material W arranged between the pairs of the punch and the die (for example, a set of punch P50 and the die D50 with respect to a set of punch P51 and the die D51) disposed adjacent to each other in the y-direction maintain a fair surface (straight line in the figure) during the bending process, the length of the link (distance of a straight line between pivots) is set up for a descending distance of the pedestal $L_1$, a moving distance needed for the punch P and the die D in the t-direction from the start to the completion of the bending process and a distance between both pivots of the link before the bending process starts.

For example, in case when considering the third link L13 as an example, a descending amount (descending distance of the pedestal $L_1$) of the moving pedestal PR2 of the press section PR is set to y, a moving amount of the punch or the die in the t-direction needed to bend the plate-shaped material W (a moving distance of the punch P and the die D needed from the start to the completion of the bending process in the t-direction) is set to x, an initial gap amount of the pivotal center axis position of the link and the pivot position of the punch and the die (a distance of both pivots of the link in the t-direction before the start of the bending process) in the t-direction is set to a In this case, the length of the link L (distance in a straight line between the pivots) needed to move the punch and the die for a moving amount x can be determined by the following formula.

$$L^2=(x^2+y^2)\{y^2+(2a+x)^2\}/4y^2$$

By configuring the bending apparatus 5 with the above described configuration, a plurality of pairs of the punch and the die can be moved and driven in response to each other by converting the displacement of one way of the moving pedestal PR2.

Here, moving in response to each other refers to as following.

The value of the bending angle θ for example, θ1 and θ2, which is formed by two surfaces (for example, surfaces w1 and w2 and surfaces w2 and w3), that sandwich a ridge (for example, ridges r1 and r2) being a bent section O bent by a plurality of pairs of the punch P and the die D (for example, the punch P50 and the die D50 and the punch P51 and the die D51), is maintained the same value during the bending process. Also the surfaces (for example, surfaces w1 and w3) of the plate-shaped material W that become parallel to each other at the time of completion of the bending process or the extended surface of those surfaces are maintained to be parallel to each other at all times during the bending process. Hence, moving in response to each other refers to controlling and relatively moving the punch and the die, for example, the punch P50 and the die D50 and the punch P51 and the die D51 in the t-direction and the y-direction, in response to each other so that the plate-shaped material W (for example, surface w2), which is arranged between a set of the punch P50 and the die D50 and a set of the punch P51 and the die D51 disposed adjacent to each other in the y-direction, maintains a fair surface (straight line in the figure) during the bending process.

As described above, a bending is performed on a plurality of places on the plate-shaped material by moving the punch P50 and die D50 and the punch P51 and die D51 in response to each other and relatively moving the punch P50 and die D50 and the punch P51 and die D51 to the t-direction and y-direction, respectively. That is, a bending on a plurality of places can be performed in one process. Therefore, productivity can be improved, and reduction of strength of the completed parts can be prevented without stretching the material just as in a drawing process.

The leading edge section of a punch is shaped into a convex section of a triangle-shape having less than 180 degrees. The leading edge section of the die is shaped into a concave section of a triangle shape having less than 180 degrees just as in the punch.

A bent sheet metal A5 having 90 degrees of a bending angle θ as illustrated in FIG. 16 can be processed by arranging a leading edge section of the punch with a triangle shaped convex section having 90 degree angle on a leading edge section and by arranging the leading edge section of the die with a triangle shaped concave section having 90 degree angle on the trough just as in the punch.

With the above described configuration, the bending to a plurality of places can be performed in one process. Thus, there is no need to replace the plate-shaped material and the bent sheet metal part can be safely produced while amount of production per unit of time can be increased.

Also the plate-shaped material is processed without sliding between the punch and the die. Therefore, a plate-shaped material bending apparatus with high mechanical strength that can produce a high quality bent sheet metal without scratches during the processing while maintaining a required accuracy.

And it is desirable that the shape of the leading edge section (convex section of a triangle-shape) of all the punches P is the same, and the shape of the leading edge section (concave section of a triangle-shape) of all of the die D is the same.

In this case, a design and structure of a linkage mechanism become simple.

Figure 17:
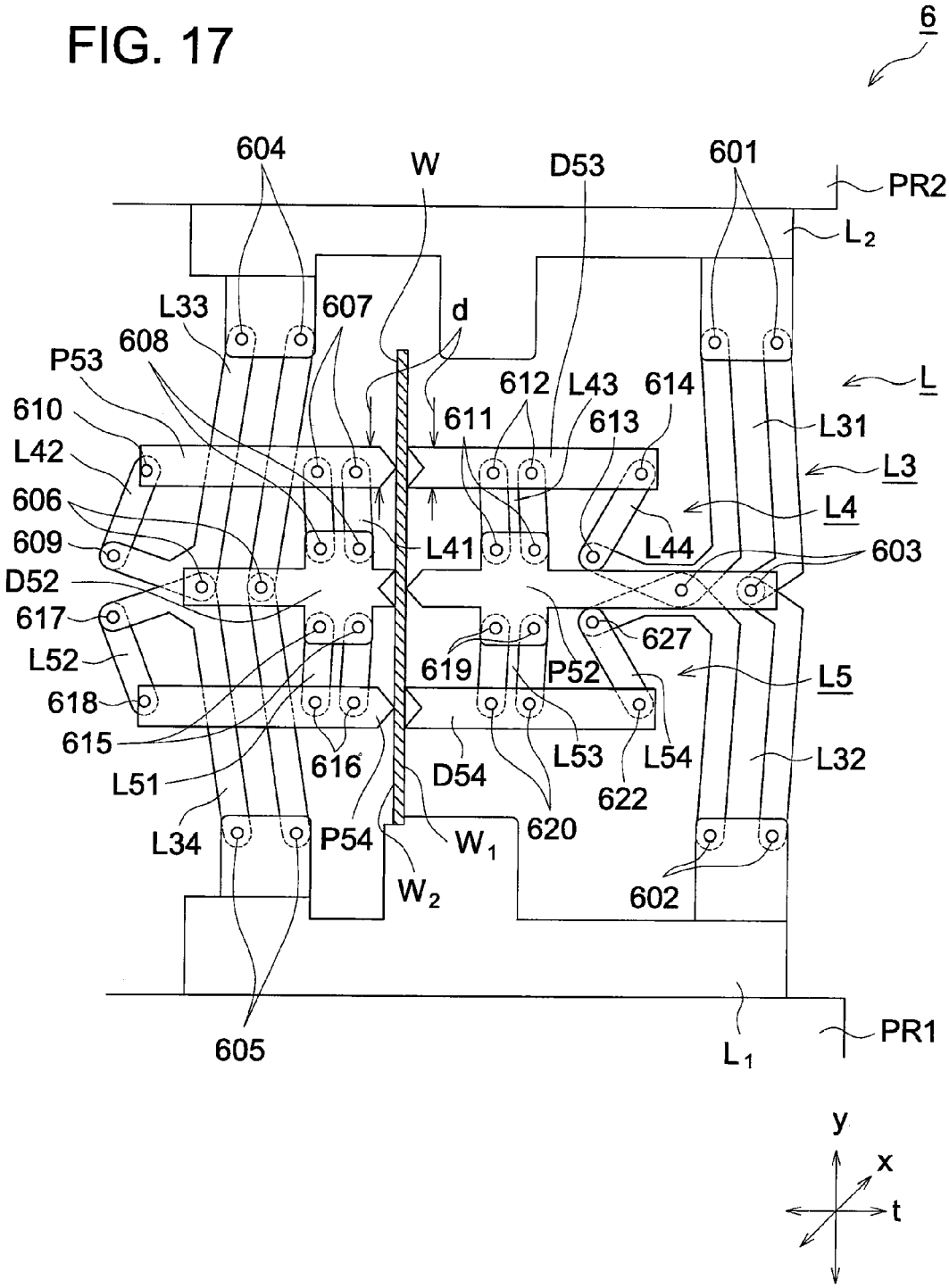
FIG. 17 is an explanatory view of sixth example of bending apparatus to perform bending of a plate-shaped material W by biasing a punch and a die via a link mechanism.
Figure 18:
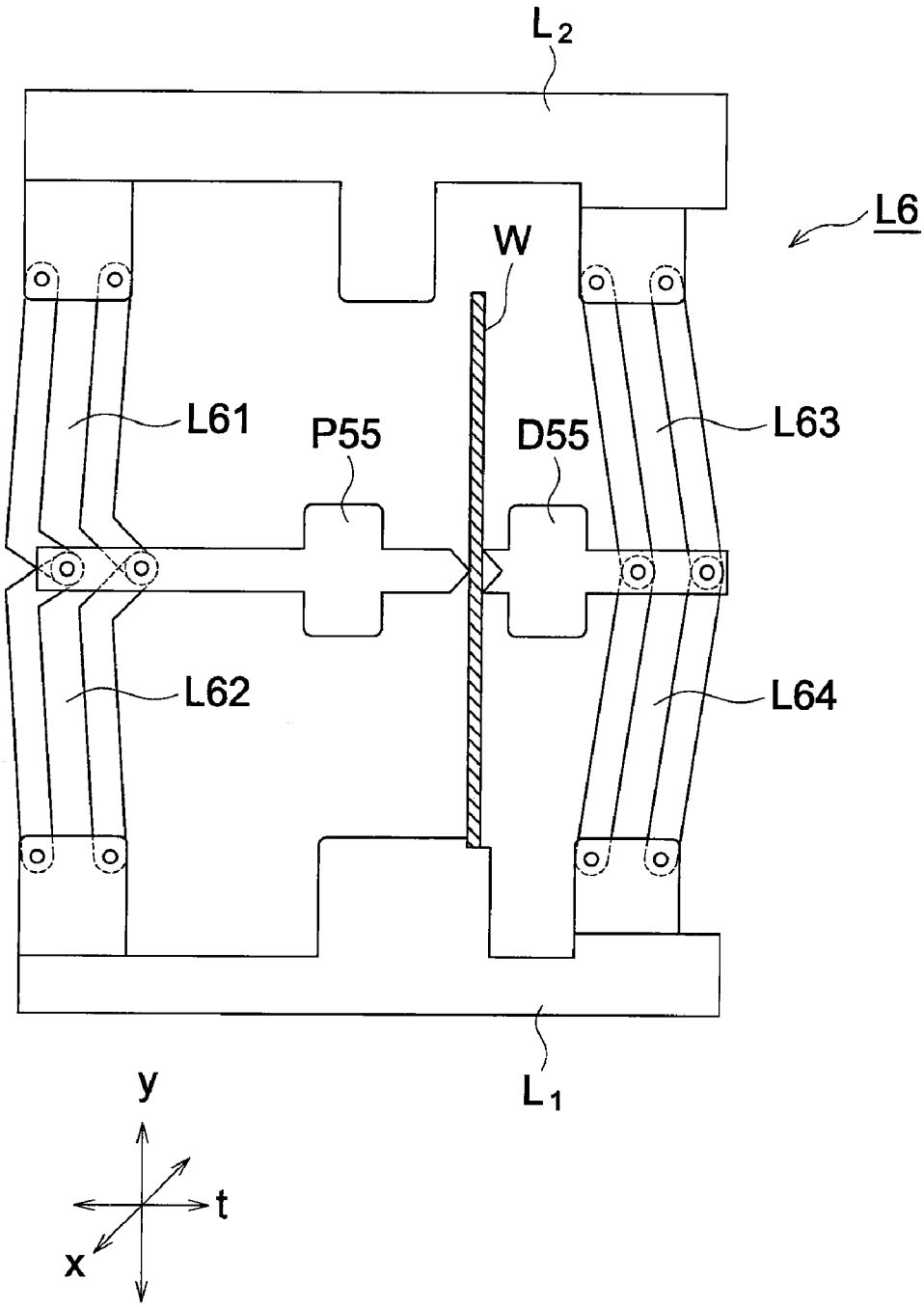
FIG. 18 is an explanatory view of sixth example of bending apparatus to perform bending of a plate-shaped material W by biasing a punch and a die via a link mechanism.
Figure 19:
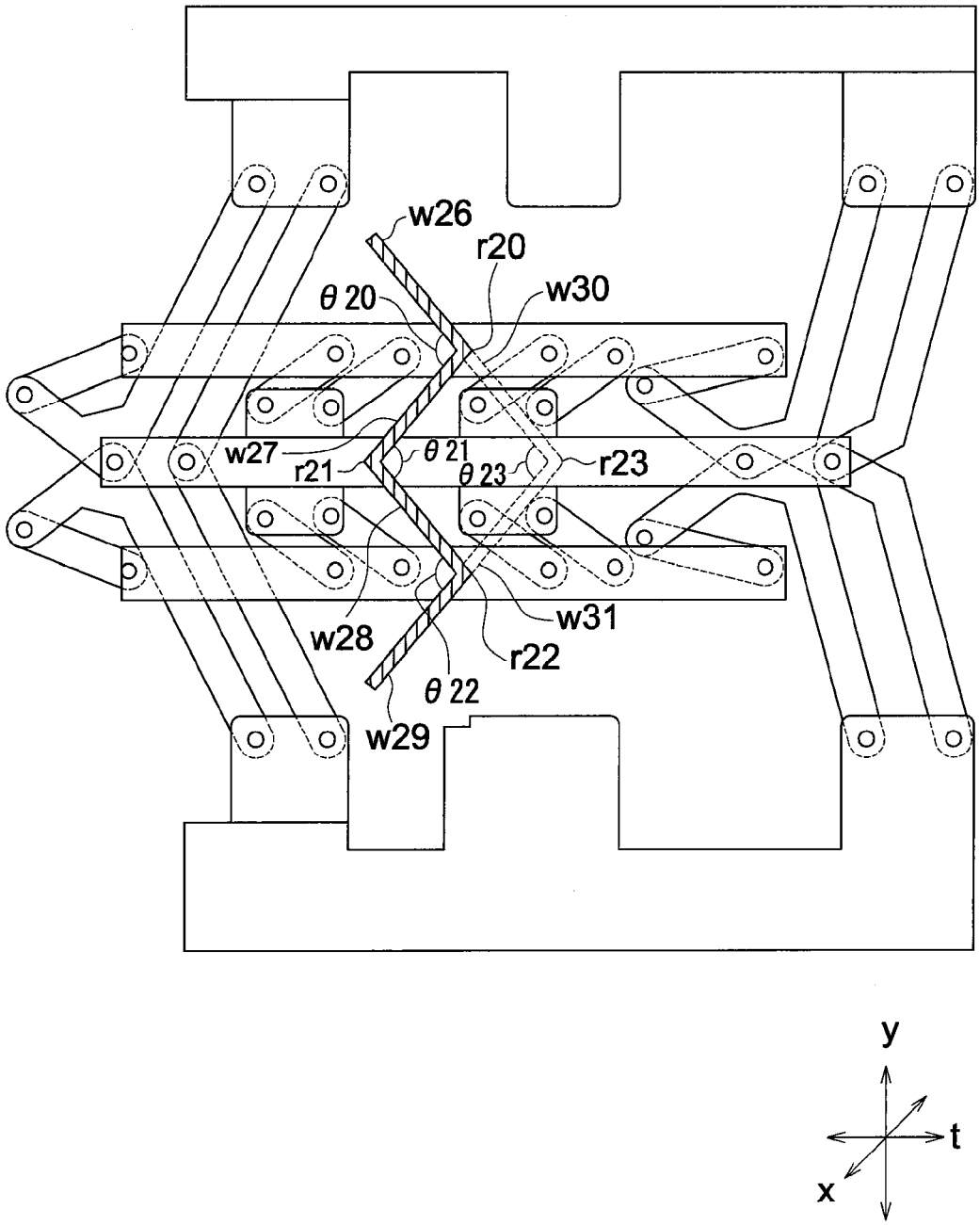
FIG. 19 is an explanatory view of sixth example of bending apparatus to perform bending of a plate-shaped material W by biasing a punch and a die via a link mechanism.
Figure 20:
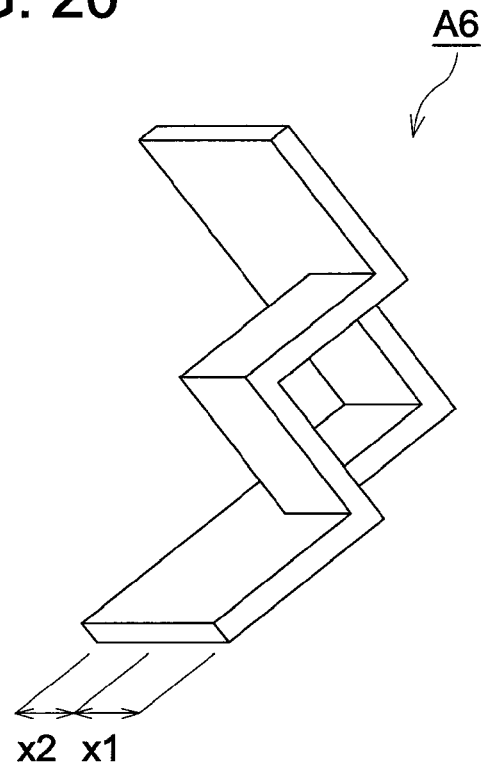
FIG. 20 is a perspective view of a part which has been formed by bending a plate-shaped material W in different woks in aback side and a front side in a x direction through a bending apparatus 6.

FIGS. 17, 18 and 19 illustrate explanatory diagrams of a sixth example of a bending apparatus, which energizes the punch P and the die D via a linkage mechanism and bends the plate-shaped material W. FIG. 20 illustrates a perspective view of a part onto which a different bending process has been performed on the near side and the far side of the plate-shaped material W in the x-direction.

In detail, FIG. 17 illustrates the time when the plate-shaped material W has been set to a bending apparatus 6. FIG. 18 illustrates an explanatory diagram of a linkage mechanism L6 viewed from the same point as FIG. 17.

In FIGS. 17, 18 and 19, the bending apparatus 6 includes a link section L, which presses and bends the plate-shaped material W, and above mentioned press section PR (not illustrated) being the driving force of the bending.

A pedestal $L_1$ of the link section L is fixed to a pedestal PR1 of the press section PR. A moving pedestal $L_2$ of the link section L is fixed to a moving pedestal PR2 of the press section PR The bending apparatus 6 is configured so that the bending to the plate-shaped material W can be performed by lowering the moving pedestal $L_2$ for a predetermined distance with the lowering of the moving pedestal PR2.

The link section L has a plurality of linkage mechanisms, which bend the plate-shaped material W with the punch and the die. For example, the link section includes a linkage mechanism L3 and linkage mechanism L4 being the first processing device, a linkage mechanism L5 being the second processing mean and a linkage mechanism L6 being the first processing device. The linkage mechanism L3 is provided between the pedestal $L_1$ and a moving pedestal $L_2$. The linkage mechanism L4 and the linkage mechanism L5 are provided on a punch P52 and a die D52. In the same manner as the linkage mechanism L3, the linkage mechanism L6 is provided between the pedestal $L_1$ and the moving pedestal $L_2$.

The linkage mechanism L3, linkage mechanism L4 and linkage mechanism L5 are disposed on the near side of the x-direction. The linkage mechanism L6 and the linkage mechanism U are disposed on the far side of the x-direction. The bending apparatus 6 is arranged so that different bending can be performed on the near side of the x-direction and the far side of the x-direction.

The linkage mechanism 13 includes an eighth link L31 and a ninth link L32, which move the punch 52 in y-direction and t-direction as drawing a circle while maintaining a parallel with respect to the pedestal $L_1$, and a tenth link L33 and an eleventh link L34, which move the die D52 as drawing a circle while maintaining a parallel to the pedestal $L_1$. Each of the eighth link L31, the ninth link L32, the tenth link L33 and the eleventh link L34 is configured by a pair of parallel links.

The linkage mechanism L4 includes a thirteenth link L41, which moves the punch P53 in y-direction and t-direction as drawing a circle while maintaining a parallel to the die D52, a fourteenth link L42, which energizes the punch P53, a fifteenth link L43, which moves the die D53 in y-direction and t-direction as drawing a circle while maintaining a parallel with respect to the punch P52, and a sixteenth link L44, which energizes the die D53. Each of the thirteenth link L41 and the fifteenth link L43 are configured by a pair of parallel links.

The linkage mechanism L4 moves the punch 53 and the die 53 to reduce the interval of the die 53 and the punch 53 with respect to the punch 52 and the die D52 in y-direction while reducing the interval of the punch P53 and the die D53 in t-direction.

The linkage mechanism L5 includes a sixteenth link L51, which moves the punch P54 in y-direction and t-direction as drawing a circle while maintaining a parallel to the die D52, a seventeenth link L52, which energizes the punch P54, a eighteenth link L53, which moves the die D54 in y-direction and t-direction as drawing a circle while maintaining a parallel to the punch P52, and a nineteenth link L54, which energizes the die D54. Each of the sixteenth link L51 and the eighteenth link L53 is configured by a pair of parallel links.

The linkage mechanism L5 moves the punch 54 and the die 54 to reduce the interval of the die 54 and the punch 54 with respect to the punch 52 and the die D52 in y-direction while reducing the interval of the punch P54 and the die D54 in t-direction.

A plurality of punch units disposed adjacent to each other in y-direction, for example, the punch P53 and the die D53, the punch P52 and the die D52 and the punch P54 and the die D54, which are disposed on the near side of the x-direction, is arranged so that the bending direction of the punch unit to the surface of the plate-shaped material differs from that of the adjacent punch unit.

In detail, for example, the die D52 is disposed on the surface $W_2$ side and the punch P52 is disposed on the surface $W_1$ side where the punch P53 is disposed on the surface $W_2$ side and the die D53 is disposed on the surface $W_1$ side. Also, the punch P54 is disposed on the surface $W_2$ side and the die D54 is disposed on the surface $W_1$ side where the die D52 is disposed on the surface $W_2$ side and the punch P52 is disposed on the surface $W_1$ side. The plurality of punch units is configured as described above so that the bending direction of pairs of the punch and the die disposed adjacent to each other in y-direction against the plate-shaped material W becomes opposite of each other.

That is, the punch P52 and the die D52 being the first processing device are capable of bending one surface of the plate-shaped material W to not more than 180 degrees by pressing the plate-shaped material W. The punches P53 and P54 and the dies D53 and D54 being the second processing device are capable of bending the other surface of the plate-shaped material W to not more than 180 degrees by pressing the plate-shaped material W.

Each of the above described punch and die has a length that is the same as the width of the bending area x1 or a length that is not less than the width of the bending area x1.

The linkage mechanism L6 disposed in the far side of the linkage mechanisms L3, L4 and L5 in the x-direction, that is in the bending area x2 of the far side, has a configuration in which the linkage mechanism L3 has been rotated 180 degrees centering around a y axis as illustrated in FIG. 18. The linkage mechanism L6 moves the punch P55 equivalent to the punch P52 and the die D55 equivalent to the die D52 in the t-direction and the y-direction as drawing a circle while maintaining a parallel to the pedestal $L_1$.

With respect to the spatial relationship of the punch P55 and the die D55 to the surface of the plate-shaped material, the punch P55 and the die D55 are arranged so that the plate-shaped material W has a convex section projected in opposite direction on the front and the back surface in the bending area x1 and the bending area x2. For example, in the bending area x2, the punch P55 is disposed on the surface W2 side and the die D55 is disposed on the surface W1 side with respect to the punch P52 disposed on the surface W1 and the die D52 disposed on the surface W2 side in the bending area x1. The punch P55 and the die D55 have a length that is the same as the length of the bending area x2 in the x-direction or a length that is not less than the length of the bending area x2 in the x-direction.

The linkage mechanism L6 includes a twentieths link L61 (equivalent to the ninth link L31) and the twenty-first link L62 (equivalent to the tenth link L32), which move the punch P55 in the t-direction and the y-direction as drawing a circle while maintaining a parallel to the pedestal $L_1$, and a twenty-second link L63 (equivalent to the eleventh link L33) and a twenty-third link L64 (equivalent to the twelfth link 34), which move the die D55 in the t-direction and the y-direction as drawing a circle while maintaining a parallel to the pedestal $L_1$.

Here, since the twentieth link L61, the twenty-first link L62, the twenty-second link L63 and a twenty-fourth link L64 have the same configuration and the effect as the ninth link L31, tenth link L32, eleventh link L33 and twelfth link L34, respectively, a detailed description is omitted.

As described above, a bending is performed on a plurality of places on the plate-shaped material by moving the punch P52 and die D52-the punch P55 and die D55 in response to each other and relatively moving the punch P52 and die D52-the punch P55 and die D55 to the t-direction and y-directions, respectively. That is, a bending on a plurality of places can be performed in one process. Therefore, productivity can be improved, and reduction of strength of the completed parts can be prevented without stretching the material just as in a drawing process.

Thereby, the plate-shaped material W has a convex section on each of the bending area x1 and the bending area x2 whose projected direction oppose each other.

The punches P53, P52 and P54 and the dies D53, D52 and D54 disposed on the near side have a length that is the same as the width of the bending area x1 in the x-direction or a length that is not less than the width of the bending area x1 in the x-direction. The punch P55 and the die D55 disposed on the far side have a length that is equal to or more than the width in the x direction of the bending area x2.

The far side edges (not illustrated) of the punches P53, P52 and P54 and the dies D53, D52 and D54 disposed on the near side come slidably in contact with the near side edges (not illustrated) of the punch P55 and the die D55 disposed on the far side.

Far side edges (not illustrated) of the leading edge sections of the punches P53, P52 and P54 and the dies D53, D52 and D54 are arranged to be an edge of not more than 90 degrees. Also near side edges (not illustrated) of the leading edge sections of the punch P55 and the die D55 are arranged to be an edge of not more than 90 degrees. The punches and the dies are moved in the t-direction. By sliding the above mentioned edges of the punches and the dies disposed on the bending area x2 and of the punches and the dies disposed on the bending area x1, the plate-shaped material is cut. Then a slit is formed with the plate-shaped material W.

A distortion of the plate-shaped material. W from a mutual interference of the bending in the bending area x1 and the bending area x2 can be prevented with this slit.

In the configuration above, the value of the bending angle θ, for example, θ20, θ21, θ22 and θ23, which is formed by two surfaces, for example, surfaces w26 and w27, surfaces w27 and w28, surfaces w28 and w29 and surfaces w30 (w26) and w31 (w29), that sandwich a ridge, for example, a ridges r20, r21 and r22, being a bent section O bent by the punch P and the die D, is maintained the same value during the bending process. Also the surfaces of the plate-shaped material that become parallel to each other at the time of completion of the bending process or the extended surface (for example, surface w30 or surfaces w26 and w28 and surface w31 or surfaces w29 and w27) of those surfaces are maintained to be parallel to each other at all times during the bending process. Hence, in order to have all of the plate-shaped material W arranged between the pairs of the punch and the die (for example, for example, the punch P53 and the die D53 to the punch P52 and the die D52, the punch P54 and the die D54 to the punch P52 and the die D52, the punch P53 and the die D53 to the punch P55 and the die D55 and the punch P54 and the die D54 to the punch P55 and the die D55) disposed adjacent to each other in the y-direction maintain a fair surface (straight line in the figure) during the bending process, the length of the link (distance of a straight line between pivots) is set for a descending distance of the pedestal $L_1$, a moving distance needed for the punch P52 and the die D52 in the t-direction from the start to the completion of the bending process and a distance between both pivots of the link before the bending process starts.

By configuring the bending apparatus 6 with the above described configuration, a plurality of pairs of the punch and the die can be moved and driven in response to each other by converting the one way displacement of the moving pedestal PR2.

In FIGS. 18 and 19, the value of the bending angle θ, for example, θ23, which is formed by two surfaces (for example, surfaces w30 and w31), that sandwich a ridge (for example, ridge r23) being a bent section O bent by a plurality of pairs of the punch P and the die D (for example, the punch P55 and the die D55) disposed in the bending area x2, is maintained the same value during the bending process. The value of the bending angle θ (for example, θ21, θ20 and θ22), which is formed by two surfaces (for example, surfaces w27 and w28, surfaces w26 and w27 and surfaces w28 and w29), that sandwich a ridge (for example, ridges r21, r20 and r22) being a bent section O bent by a plurality of pairs of the punch P and the die D (for example, the punch P52 and the die D52, the punch P53 and the die D53 and the punch P54 and the die D54) disposed in the bending area x1, is maintained the same value during the bending process. Also the surfaces (for example, surfaces w26, w28 and w30 and surfaces w29, w27 and w31) of the plate-shaped material that become parallel to each other at the time of completion of the bending process or the extended surface of those surfaces are maintained to be parallel to each other at all times during the bending process. Moving in response to each other refers to controlling and relatively moving the punch and the die, for example, punch P52 to punch P55 and die D52 to die D55 in the t-direction and the y-direction with a linkage mechanism so that the plate-shaped material W (for example, surfaces w27, w28, w30 and w30), which is arranged between the punch P53 and the die D53, the punch P52 and the die D52 and the punch P54 and the die D54 disposed in the y-direction in the bending area x1 and the punch P55 and the die D55 disposed in the y-direction in the bending area x2, maintains a fair surface (straight line in the figure) during the bending process.

The leading edge section of a punch is formed into a convex section of a triangle shape having not more than 180 degrees. The leading edge section of the die is formed into a concave section of a triangle shape having not more than 180 degrees just as in the punch. Hence, a bent sheet metal part having an arbitrary bending angle not more than 180 degrees can be processed.

A bent sheet metal A6 having 90 degrees of a bending angle θ as illustrated in FIG. 20 can be processed by arranging a leading edge section of the punch with a triangle-shaped convex section having 90 degree angle on a leading edge section and by arranging the leading edge section of the die with a triangle-shaped concave section having 90 degree angle on the trough just as in the punch.

And it is desirable that the shape of the leading edge section (convex section of a triangle shape) of all the punches P is the same, and the shape of the leading edge section (concave section of a triangle shape) of all the die D is the same. In this case, a design and structure of a linkage mechanism become simple.

By using the configuring described above, as the same as the effect explained by referring the configuration described in FIGS. 14 and 15, there is provided a bent sheet metal having a convex section projected in the opposite direction on the front and the back surface of the plate-shaped material W in the bending area x1 and the bending area x2 by the linkage mechanism.

Figure 21:
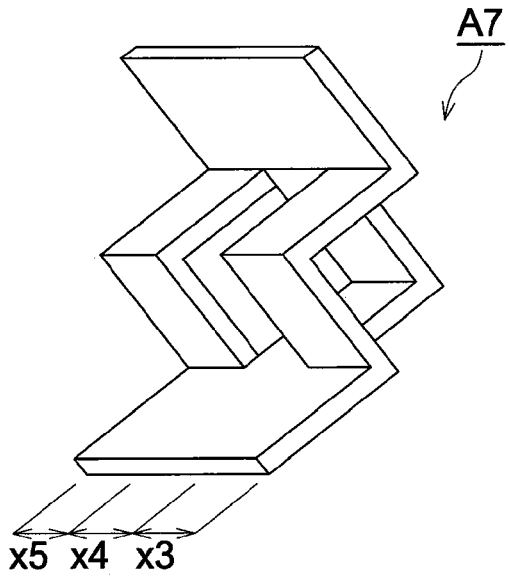
FIG. 21 is an explanatory view of a seventh example of a part which is formed by bending a plate-shaped material W.

FIG. 21 illustrates an explanatory diagram of a seventh example of a part obtained by applying a bending process to the plate-shaped material W.

For example, a linkage mechanism that is the same as the linkage mechanism L3, the linkage mechanism L4 and the linkage mechanism L5 is added to the far side of the linkage mechanism L6 in the x-direction in the figure as illustrated in FIGS. 17 and 18. Hence, as illustrated in FIG. 21, a bent sheet metal A7 having a convex section projected in the opposite direction on the front and the back surfaces of the plate-shaped material W can be produced.

A configuration, which forms a limited slit not longer than the length of the plate-shaped material W in the y-direction while the edge of the punch and the die has been bent into the edge shape has been described above in reference to FIGS. 8 and 9, FIGS. 11 and 12 and FIGS. 17, 18, and 19. However, one end of the slit may be extended to the edge of the plate-shaped material W. In this case, a bent part whose one end is cutout can be produces.

Figure 22:
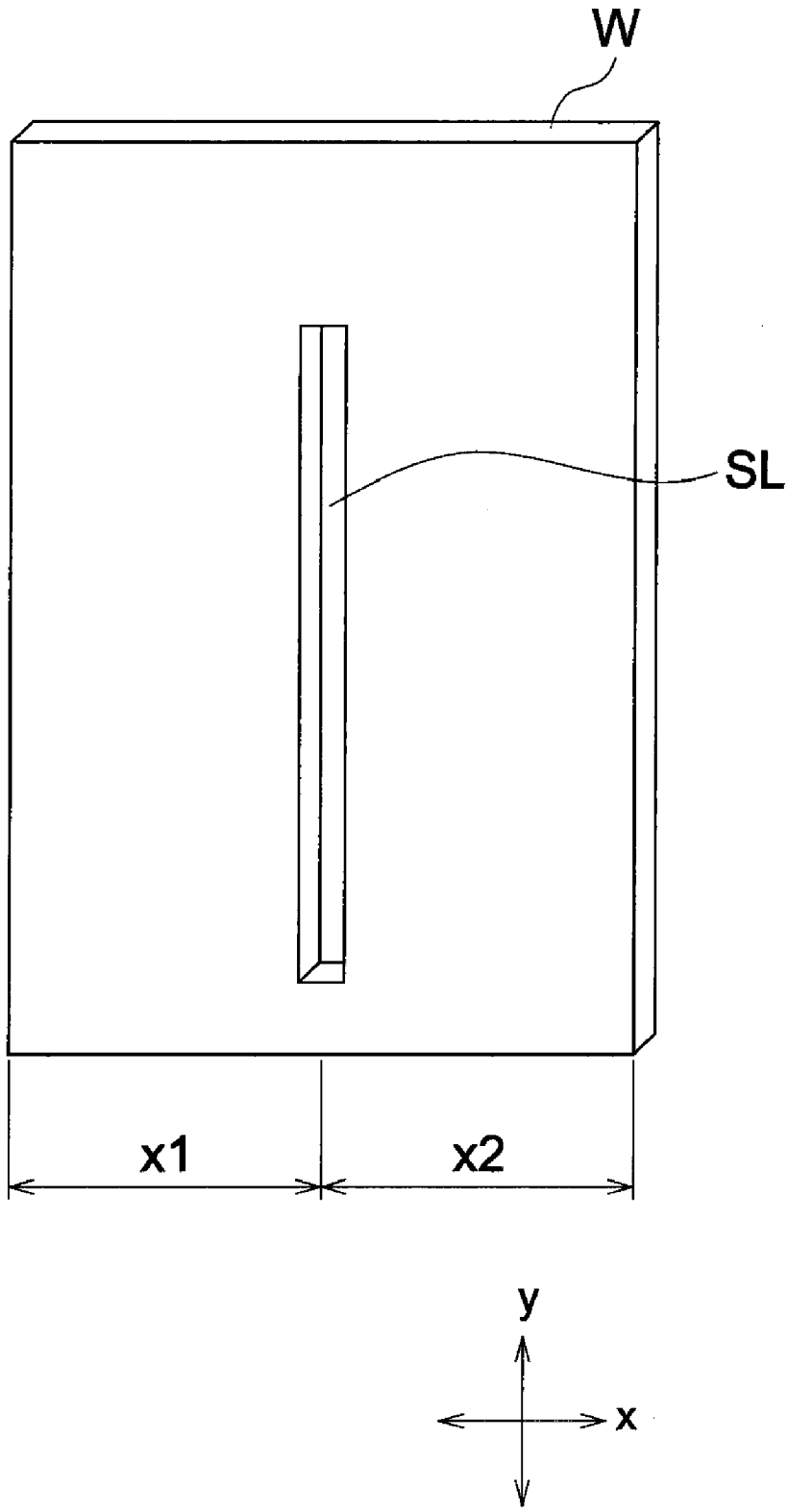
FIG. 22 is an external view of a plate-shaped material Won which slits are formed in advance.
Figure 23A:
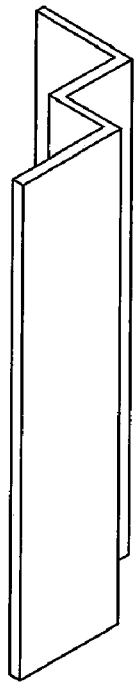
FIG. 23(*a*) and FIG. 23(*b*) are examples of parts which are formed by bending plate-shaped materials such as metal at a plurality of positions.
Figure 23B:
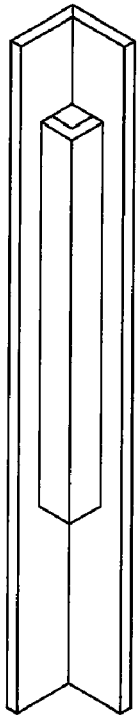

FIG. 22 illustrates an external view of a plate-shaped material W' onto which a slit has been formed in advance.

A configuration, which forms a slit while bending the sheet metal by using the edge of the punch and the die, has been described above in reference to FIGS. 8 and 9, FIGS. 11 and 12 and FIGS. 17, 18, and 19. However, a plate-shaped material onto which a slit has been formed in advance can be bent as well.

With respect to the plate-shaped material W' onto which a slit has been formed in advance, a slit SL extending to a predetermined width in the y-direction is formed on the boundary of the bending area x1 of the near side and the bending area x2 of the far side in the x-direction. The predetermined width is to be not narrower than the variation in the x-direction at the time when plate-shaped material W' is set to the bending apparatus, for example, approximately 0.5 mm-2 mm.

In case when there are at least not less than three bending areas and a plurality of punches and dies is disposed in the x-direction of the bending apparatus, it is needless to mention that at least not less than two slits SL may be provided in advance.

The plate-shaped material W' can be suitably used as a plate-shaped material used in the bending apparatus in which the edges of the punch and the die have not been formed into an edge shape. One end of the slit SL can be structured into an opened cutout state accordingly.

It becomes unnecessary to form the edge of the punch and the die into an edge shape by forming a slit on the plate-shaped material in advance. Also the edges of die punches adjacent to each other in the x-direction do not need be slidable. Thus, a plate-shaped material bending apparatus with a good maintenance nature can be realized.

A bending has been described above. However, it is needless to mention that the plate-shaped material can be bent by the punch and the die having a leading edge of a circular arch shape.

EFFECT OT THE INVENTION

With the above described invention, there is provided a processing apparatus and a processing method, which can safely produce a large number of sheet metal parts in a unit time by bending a plate-shaped material having a high mechanical strength while securing the accuracy demanded with little scratches.

What is claimed is:

1. A forming apparatus to bend a plate-shaped material, comprising:

a first forming device to bend the plate-shaped material in a first bending direction along a first axis that is perpendicular to a surface of the plate-shaped material;

a second forming device to bend the plate-shaped material in a second bending direction opposite to the first bending direction, said second bending direction also being along the first axis;

wherein the first and the second forming devices are configured, in a bending process, to press the plate-shaped material synchronously in parallel along the first axis in the respective first and second bending directions, while changing a relative position to each other along the first axis and along a second axis which is perpendicular to the first axis.

2. The forming apparatus of claim 1, wherein the first forming device and the second forming device are configured so that a bending angle created by the first forming device and a bending angle created by the second forming device always maintains substantially a same value during the bending process.

3. The forming apparatus of claim 1, wherein the first forming device and the second forming device are configured so that surfaces of the plate-shaped material which are to be substantially parallel with each other when the bending process is completed are maintained in parallel with each other during the bending process.

4. The forming apparatus of claim 3, wherein each of the first forming device and the second forming device comprises:

a pair of a punch and a die to press the plate-shaped material, a punch moving device to move the punch along the first axis to press the plate-shaped material, and to move the punch along the second axis, and a die moving device to move the die along the first axis to press the plate-shaped material, and to move the die along the second axis.

5. The forming apparatus of claim 4, wherein the first forming device and the second forming device are disposed alternately along the second axis, so that the punch of the first forming device is disposed at an obverse surface side of the plate-shaped material and the die of the first forming device is disposed at a reverse surface side of the plate-shaped material so as to bend the plate-shaped material in the first bending direction, and the punch of the second forming device is disposed at the reverse surface side of the plate-shaped material and the die of the second forming device is disposed at the obverse surface side of the plate-shaped material so as to bend the plate-shaped material in the second bending direction.

6. The forming apparatus of claim 5, further comprising a plurality of the first forming devices and a plurality of the second forming devices.

7. The forming apparatus of claim 4, wherein the punch moving device comprises a first motor as a drive source to move the punch along the first axis, a second motor as a drive source to move the punch along the second axis, and a punch moving section to convert rotation of the first motor and the second motor into movements along the first axis and the second axis, and wherein the die moving device comprises a third motor as a drive source to move the die along the first axis, a fourth motor as a drive source to move the die along the second axis, and a die moving section to convert rotation of the third motor and the fourth motor into movements of the die along the first axis and the second axis.

8. The forming apparatus of claim 7, further comprising a control device to control the first motor, the second motor, the third motor, and the fourth motor, wherein the control device controls the first motor, the second motor, the third motor, and the fourth motor so that a bending angle formed by the first forming device and a bending angle formed by the second forming device coincide during bending, and surfaces of the plate-shaped material which are to be substantially parallel with each other at a time of completion of the bending process or the extended surfaces thereof are always parallel with each other during the bending process.

9. The forming apparatus of claim 4, wherein the punch moving device and the die moving device have a link mechanism to move the punch and the die along the first axis and the second axis relatively through a single drive source, wherein the link mechanism moves the punch and the die so that a bending angle formed by the first forming device and a bending angle formed by the second forming device always coincide during the bending process, and surfaces of the plate-shaped material which are to be substantially parallel with each other at a time of completion of the bending process or extended surfaces thereof are always parallel during the bending process.

10. The forming apparatus of claim 1, wherein the first forming device and the second forming device are arranged alternately along a third axis which is perpendicular to the first axis and the second axis.

11. The forming apparatus of claim 10, further comprising a plurality of the first forming devices and a plurality of the second forming devices, wherein the plurality of the first forming devices and the plurality of the second forming devices are arranged along the third axis.

12. The forming apparatus of claim 10, wherein the first forming device and the second forming device each comprise a pair of a punch and a die, and each of the punches and dies which are adjacent to each other along the third axis have cutting edges which are configured to slide against each other during the bending process so as to shear the plate-shaped material therebetween to form a slit in the plate-shaped material.

* * * * *